US007182454B2

(12) United States Patent
Nakazawa

(10) Patent No.: US 7,182,454 B2
(45) Date of Patent: Feb. 27, 2007

(54) INK JET RECORDING APPARATUS

(75) Inventor: Yusuke Nakazawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 266 days.

(21) Appl. No.: 10/767,060

(22) Filed: Jan. 30, 2004

(65) Prior Publication Data

US 2004/0183879 A1 Sep. 23, 2004

(30) Foreign Application Priority Data

Jan. 30, 2003 (JP) ..... 2003-021932

(51) Int. Cl.
*B41J 2/01* (2006.01)

(52) U.S. Cl. ..... 347/102; 347/103

(58) Field of Classification Search ..... 347/102, 347/103

See application file for complete search history.

(56) References Cited

U.S. PATENT DOCUMENTS 3,934,112 A 1/1976 Lakahani
5,365,261 A 11/1994 Ozawa et al.
5,757,407 A * 5/1998 Rezanka ..... 347/102
5,764,263 A * 6/1998 Lin ..... 347/101
6,390,618 B1 5/2002 Wotton et al.
6,397,488 B1 6/2002 Brinkly
6,463,674 B1 10/2002 Meyers et al.
6,652,084 B1 * 11/2003 Teraoka et al. ..... 347/100

FOREIGN PATENT DOCUMENTS

GB 2 010 104 A 6/1979
JP 6-126945 A 5/1994
JP 11-320856 A 11/1999

* cited by examiner

*Primary Examiner*—Stephen Meier
*Assistant Examiner*—Ly T. Tran
(74) *Attorney, Agent, or Firm*—Sughrue Mion, PLLC

(57) ABSTRACT

The ink jet recording apparatus includes an image forming device for forming an image on a recording medium by ejecting ink containing a solvent and color particles dispersed in the solvent, a fixing device for fixing the image formed on the recording medium by the image forming device, a collecting device for selectively collecting air containing the solvent from an atmosphere in proximity to the fixing device, and a removing device for removing the solvent from the solvent-containing air collected by the collecting device.

22 Claims, 7 Drawing Sheets

INK JET RECORDING APPARATUS

BACKGROUND OF THE INVENTION

1. Field of the Invention

The present invention relates to a technical field of an ink jet recording apparatus that records an image on a recording medium by ink jet system using ink where color particles (colorant component) are dispersed in a solvent (dispersion medium). More specifically, the present invention relates to an ink jet recording apparatus that is capable of efficiently collecting solvent vapor generated from the ink.

2. Description of the Related Art

An electrostatic ink jet recording system is a system in which ink containing color particles, such as pigments, charged and dispersed in a solvent is used and an image corresponding to image data is formed on a recording medium by ejecting the ink (droplet) by means of an electrostatic force through application of a predetermined voltage to each ejection electrode of an ink ejection head in accordance with the image data. Then, the image formed on the recording medium by the ejected ink is, for instance, heated using a fixing means, thereby removing the solvent component of the ink and fixing only the color particles on the recording medium to record. Here, the ink forming the image on the recording medium contains concentrated color particles and solvent component, so that it is required to vaporize/dry and remove the ink solvent component and to fix only the color particles on the recording medium by the fixing means, for instance, a heating means or the like.

In an ink jet recording apparatus adopting such a recording system, solvent vapor is generated in an ink ejection portion, a fixing portion (in particular, a heat-fixing portion), or the like as a result of the vaporization/drying of the ink solvent component. An organic solvent is used as the ink solvent component and the emission thereof to the outside of the apparatus leads to environmental pollutions. Therefore, it is required to collect and remove the ink solvent component within the apparatus.

For this purpose, with a method conventionally and generally used in the ink jet recording apparatus, a solvent collecting device is provided in the apparatus, air in the entire region inside the apparatus is taken infusing the solvent collecting device, and the ink solvent component is collected/removed by absorbing the solvent component using a solvent adsorption material or concentrating the solvent component through cooling of the taken-in air.

However, the solvent collecting device used in the conventional ink jet recording apparatus takes in air in the entire region inside the ink jet recording apparatus, so that there is a problem that, in addition to air containing the solvent component, the solvent collecting device simultaneously takes in air containing a small quantity of the solvent component, such as the atmosphere (air in an installation environment) or the outside air flowing into the apparatus, and then a vapor concentration of the solvent component contained in the taken-in air is low, therefore the collection efficiency is decreased. In addition, water vapor contained in air inside and outside the apparatus exerts an innegligible influence on the collecting of the solvent component. In particular, a water vapor component in the taken-in air causes lowering of the collection efficiency of the solvent collecting device that collects the vapor of the solvent component, which leads to various problems such as an increase in size of the solvent collecting device, an increase in power consumption, and lowering of maintainability. Also, not only the solvent component but also the moisture is simultaneously collected, so that there is another problem that it takes a lot of trouble to reuse the solvent. Further, the air in the entire region inside the apparatus is taken in, so that particularly when the heat of the heat-fixing portion is easily transmitted to the ejection head or when air from the heat-fixing portion flows to the ejection head, the ejection head is easily dried, which leads to still another problem that ink clogging occurs due to the drying of the ejection head or ink ejection stability is lowered due to changes in viscosity of the ink.

Meanwhile, in order to suppress or prevent vaporization of a solvent component from ink forming an image on a recording medium in an ink jet recording apparatus, there have conventionally been proposed some methods for removing the solvent component from the ejected ink without allowing the solvent component to be vaporized. In JP 06-126945 A, for instance, a transfer type ink jet printer is disclosed in which color particles in ink ejected onto a transfer drum are separated from a solvent by means of an electrostatic force and are temporarily fixed on the transfer drum, the solvent is selectively absorbed/removed from the transfer drum by abutting a roller-like solvent removing means made of a material absorbing only the solvent against the transfer drum, and the color particles on the transfer drum are transferred onto and fixed on a recording medium.

With the printer disclosed in JP 06-126945 A, however, in addition to the transfer drum, the specially designed solvent removing means that absorbs/removes the ink solvent under a liquid state needs to be provided before a position at which an image formed by the ejected ink is recorded on (transferred onto) the recording medium. Therefore, there is a problem that the apparatus construction becomes complicated and the apparatus size is increased. Also, the ink forming the image on the transfer drum is mainly composed of the color particles and it is difficult to completely remove the solvent component from the ink, therefore when the printer is continuously operated or a large amount of print is outputted, there is another problem that it is also required to remove the solvent component vaporized from images transferred onto recording media.

Also, as a method of circumventing a situation where vaporization of an ink solvent on a print medium continues for a long time, JP 11-320856 A discloses a liquid ejection printer in which vaporization of a solvent of ink ejected onto a print medium is accelerated using a means for forcibly vaporizing the ink solvent by heating the ink on the print medium in a non-contact manner immediately after recording on a print medium transport path, by sucking air around a surface of the print medium immediately after recording, or by reducing a pressure in a cover box provided so as to cover the whole of the print medium transport path at a position immediately after an ink ejection portion. JP 11-320856 A also discloses a liquid ejection printer that includes a means for collecting an ink solvent by absorbing the ink solvent using an absorbing agent provided inside a cover box provided so as to cover an ink ejection portion and the whole of a print medium transport path, a means for collecting the ink solvent by coagulating (concentrating) and liquefying ink solvent vapor through cooling of air inside the cover box using a cooling apparatus provided inside the box, or the like. JP 11-320856 A further discloses a liquid ejection printer that includes a means for forming a layer of hardener by spraying a hardener serving as an ink vaporization suppression agent onto a print medium immediately after recording.

With the technique disclosed in JP 11-320856 A, however, in the case of the printer that circumvents a situation where vaporization of a solvent of ink ejected onto a print medium continues for a long time using the means for heating the ink on the print medium in a non-contact manner immediately after recording on the print medium transport path or the means for sucking air around a surface of the print medium immediately after recording, there is a problem that it is impossible to collect the ink solvent vaporized as a result of heating or sucking. Also, in the case of the printer including the cover box that covers the whole of the print medium transport path or the ink ejection portion as well as the whole of the transport path, there is a problem that the apparatus construction becomes complicated and the apparatus increases in size. Further, in the case of the printer that accelerates the ink solvent vaporization using the heating means or the sucking means provided immediately after the ejection head or the printer that uses the cover box that covers the whole of the print medium transport path and the ink ejection portion, there is a problem that drying of the ejection head or changes in viscosity of ejection ink may exert adverse effects. Also, in the case of the printer including the means for forming the layer of the ink vaporization suppression agent on a print medium immediately after recording, there is a problem that the cost of outputted prints is increased.

SUMMARY OF THE INVENTION

A primary object of the present invention is to solve the problems of the conventional techniques described above, and to provide an ink jet recording apparatus that is capable of selectively collecting air containing solvent vapor in a region in proximity to a fixing means that generates the largest quantity of solvent vapor, reducing an influence of a water vapor component in the collected air, efficiently removing the solvent vapor, miniaturizing the apparatus, reducing power consumption (achieving power saving), and improving maintainability, that is, achieving a stabilized operation of the apparatus.

Further, in addition to the above-mentioned object, another object of the present invention is to provide an ink jet recording apparatus in which, in addition to removal of solvent vapor from collected air and reuse of the removed solvent, it becomes possible to recover heat energy generated by a fixing means and to reuse the recovered heat energy as drying energy, thereby making it possible to reduce the amount of energy used for drying and to achieve power saving.

Further, in addition to the above-mentioned respective objects, another object of the present invention is to provide an ink jet recording apparatus in which it becomes possible to prevent leakage of heat generated by a fixing means, thereby making it possible to prevent drying of ink at an image forming means (in particular, ejection nozzles of an ejection head) and to suppress lowering of stability of ink ejection due to changes in physical properties, such as viscosity, of the ink.

In order to attain the objects described above, the present invention provides the ink jet recording apparatus comprising image forming means for forming an image on a recording medium by ejecting ink containing a solvent and color particles dispersed in said solvent, fixing means for fixing said image formed on said recording medium by said image forming means, collecting means for selectively collecting air containing said solvent from an atmosphere in proximity to said fixing means, and removing means for removing said solvent from said solvent-containing air collected by said collecting means.

It is preferable that the collecting means includes shield means for shielding at least a region in proximity to said fixing means, and suction means for sucking and collecting said solvent-containing air from the region shielded by said shield means.

It is also preferable that the fixing means includes a heating section that heats and fixes said image formed on said recording medium by said image forming means, and the shield means shields at least a region in proximity to said heating section.

It is another preferable that the ink jet recording apparatus further comprises preliminary heating means for preliminary heating said recording medium on which said image has been formed by said image forming means using air which has been collected by said collecting means and from which said solvent has been removed by said removing means, or heat of said air, prior to heating and fixing by said fixing means, said preliminary heating means being provided between said image forming means and said fixing means.

It is further preferable that the collecting means includes a suction opening for said solvent-containing air, arranged in proximity to said fixing means, and blowing means for blowing said solvent-containing air in proximity to said fixing means into said suction opening.

It is still another preferable that the ink jet recording apparatus further comprises drying means for drying said recording medium on which said image has been formed by said image forming means using air which has been collected by said collecting means and from which said solvent has been removed by said removing means, or heat of said air.

It is still further preferable that the fixing means includes a heating section that heats and fixes said image formed on said recording medium by said image forming means, and the recording medium on which said image has been formed by said image forming means is preliminary heated using air which has been collected by said collecting means and from which said solvent has been removed by said removing means, or heat of said air, to assist fixing of said image by said fixing means.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

The ink jet recording apparatus according to the present invention will now be described in detail based on preferred embodiments illustrated in the accompanying drawings.

In the following description, an electrostatic ink jet recording apparatus that forms an image on a recording medium by ejecting ink where color particles (colorant component) are dispersed in a solvent will be described as a representative example of the ink jet recording apparatus according to the present invention, although the present invention is not limited to the electrostatic ink jet recording apparatus.

<First Embodiment>

Figure 1:
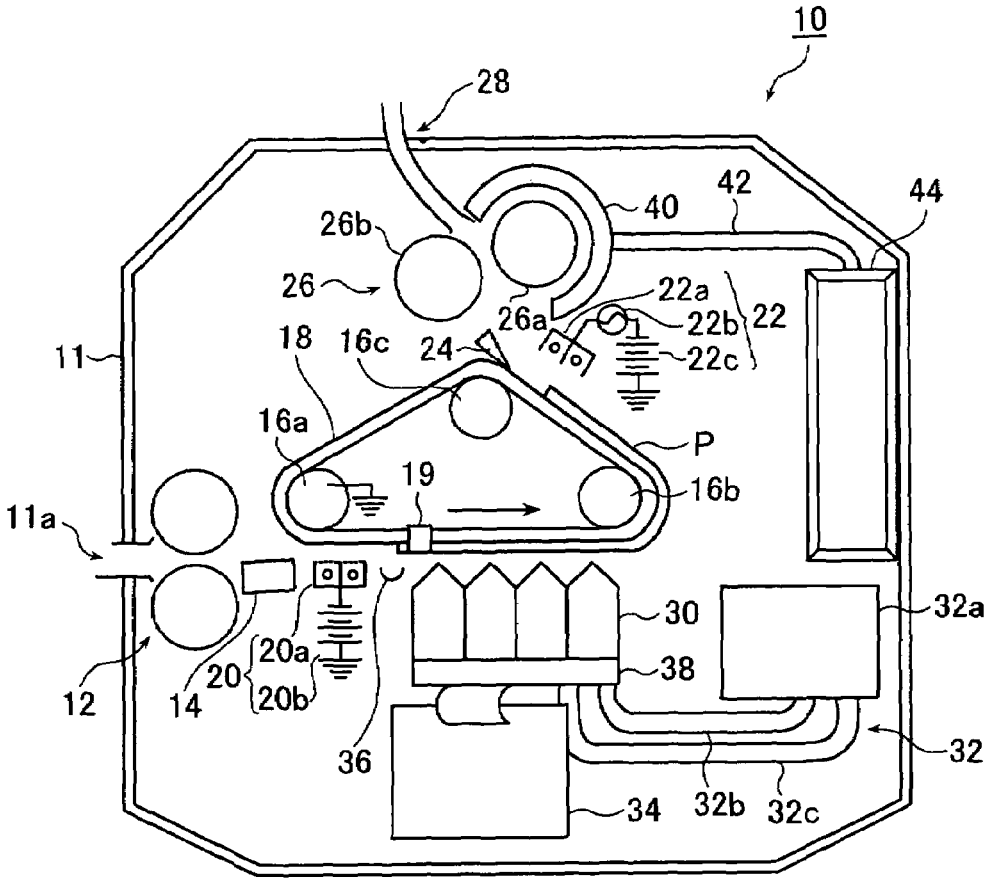
FIG. 1 is a schematic construction diagram showing a first embodiment of the ink jet recording apparatus according to the present invention.

FIG. 1 is a schematic construction diagram showing an overall construction of a first embodiment of the ink jet recording apparatus according to the present invention.

An electrostatic ink jet recording apparatus (hereinafter referred to as the "ink jet printer") 10 shown in FIG. 1 records a full-color image by forming an image of ink particles (color particles) through ejection of ink droplets in four colors in accordance with inputted image data using an image forming means onto a recording medium P transported by a transport means and fixing the image of ink particles formed on the recording medium P. Also, the ink jet printer 10 collects air containing a large quantity of ink solvent vapor from a region in proximity to a fixing/transporting means 26 using a collecting means and removes the solvent in the collected air using a removing means.

The ink jet printer 10 shown in FIG. 1 is an apparatus that performs one-sided four-color printing on the recording medium P. For this purpose, as a means for transporting the recording medium P, the ink jet printer 10 includes a feed roller pair 12, a guide 14, rollers 16*a*, 16*b*, and 16*c*, a transport belt 18, a transport belt position detection means 19, an electrostatic adsorption means 20, a discharge means 22, a peeling means 24, a fixing/transporting means 26, and a guide 28. Also, as the image forming means, the ink jet printer 10 includes an ejection head 30, an ink circulation system 32, a head driver 34, a recording medium position detection means 36, and a recording position control means 38. Further, the ink jet printer 10 includes a hood 40 and a duct 42 as the means for collecting solvent-containing air, and includes a solvent removing device 44 as the solvent removing means. These construction elements are provided in an enclosure 11.

First, the transport means for the recording medium P in the ink jet printer 10 will be described.

The feed roller pair 12 is provided adjacent to an inlet 11*a* provided on a side surface of the enclosure 11 and is composed of a pair of rollers that feed the recording medium P from a not-shown stocker to the transport belt 18 (portion supported by the roller 16*a*) provided in the enclosure 11. The guide 14 is provided between the feed roller pair 12 and the roller 16*a* supporting the transport belt 18, and guides the recording medium P to the transport belt 18.

Although not illustrated, it is preferable that a foreign matter removing means for removing foreign matters, such as dust or paper waste, adhering to the recording medium P is provided in proximity to the feed roller pair 12. As the foreign matter removing means, a means based on a known non-contact method, such as suction removal, blowing-off removal, or electrostatic removal, or a means based on a contact method using a brush, a roller, or the like may be used alone or in combination. Also, the feed roller pair 12 may be constructed using slightly adhesive rollers and a cleaner may be provided to the feed roller pair 12, which removes foreign matters, such as dust or paper waste, at the time of feeding of the recording medium P by the feed roller pair 12.

The rollers 16*a*, 16*b*, and 16*c* stretch and move the transport belt 18, and at least one of the rollers 16*a*, 16*b*, and 16*c* is connected to a not-shown drive source.

The transport belt 18 functions as a platen for holding the recording medium P and moves the recording medium P at the time of image formation by ink ejected from the ejection head 30, and transports the recording medium P to the fixing/transporting means 26 after the image formation. Consequently, an endless belt made of a material that has superior dimensional stability and high endurance is used as the transport belt 18. As the material thereof, a metal, a polyimide resin, a fluororesin, another resin, or a complex thereof is used, for instance.

In the illustrated example, the recording medium P is held on the transport belt 18 through electrostatic adsorption, so that a side (front surface) of the transport belt 18 holding the recording medium P has insulativity and a side (back surface) of the transport belt 18 contacting the rollers 16*a*, 16*b*, and 16*c* has conductivity. In more detail, the transport belt 18 is a belt produced by applying a fluororesin coat to the front surface of a metallic belt. Also, in the illustrated example, the roller 16*a* is a conductive roller and the back surface (metallic surface) of the transport belt 18 is grounded through the roller 16*a*.

It should be noted here that aside from this, a belt having a metallic layer produced with various methods, such as a method with which a metallic belt is coated with any one of the resin materials described above, a method with which a resin sheet and a metallic belt are bonded to each other using an adhesive or the like, or a method with which a metal is vapor-deposited on the back surface of a belt made of the above-mentioned resin, may be suitably used as the transport belt 18.

Also, it is preferable that the surface of the transport belt 18 contacting the recording medium P is made smooth, because with this construction, a favorable adsorption property is obtained for the recording medium P.

It should be noted here that it is preferable that meandering of the transport belt 18 is suppressed with a known method. For instance, the meandering of the transport belt 18 may be suppressed using a method with which tension at both ends in the widthwise direction of the transport belt is changed by setting the roller 16*c* as a tension roller and tilting the axis of the roller 16*c* with respect to the axes of the roller 16*a* and the roller 16*b* in accordance with an output from the transport belt position detection means 19, that is, a detected position of the transport belt 18 in the widthwise direction. Alternatively, the meandering may be suppressed by forming the rollers 16*a*, 16*b*, and 16*c* in a tapered shape or a crown shape, for instance.

The transport belt position detection means 19 detects the position in the widthwise direction of the transport belt 18. With reference to the detected position, the suppression of the meandering of the transport belt described above is performed. In addition, using the detection result, a position in the sub scanning direction of the recording medium P at the time of image recording is regulated to a predetermined position. The transport belt position detection means 19 performs the detection using a known detection means such as a photosensor.

The electrostatic adsorption means 20 charges the recording medium P to a predetermined potential, as a result of which the recording medium P is adsorbed and held on the transport belt 18 by means of an electrostatic force and applied with a predetermined bias with respect to the ejection head 30 for image formation.

In this embodiment, the electrostatic adsorption means 20 includes a scorotron charger 20*a* for charging the recording medium P and a negative high voltage power supply 20*b* connected to the scorotron charger 20*a*. The recording medium P is charged to a negative high voltage by the scorotron charger 20*a* connected to the negative high voltage power supply 20*b* and is electrostatically adsorbed on the insulation layer of the transport belt 18.

The electrostatic adsorption means 20 is not limited to the scorotron charger 20*a* of the illustrated example, and it is also possible to use various other means and methods such as a corotron charger, a solid charger, a discharge needle, and the like. Also, as will be described in detail later, at least one of the rollers 16*a*, 16*b*, and 16*c* may be set as a conductive roller or a conductive platen may be arranged on the back surface side (side opposite to the recording medium P) of the transport belt 18 at a recording position to the recording medium P. In this case, the conductive roller or the conductive platen is connected to a negative high voltage power supply. Alternatively, the transport belt 18 may be set as an insulative belt, the conductive roller may be grounded, and the conductive platen may be connected to the negative high voltage power supply (see FIG. 6).

After the recording medium P is electrostatically adsorbed on the transport belt 18 by means of an electrostatic force so that no floating of the recording medium P occurs, the electrostatic adsorption means 20 uniformly charges a surface of the recording medium P transported by the transport belt 18. Here, it is sufficient that the transport speed of the transport belt 18 at the time of the charging of the recording medium P is in a range in which the charging is performed with stability, and it does not matter whether this transport speed is the same as or is different from a transport speed at the time of image recording. Also, by circulating the recording medium P multiple times, the electrostatic adsorption means 20 may charge the same recording medium P multiple times and achieve uniform charge.

It should be noted here that in this embodiment, the electrostatic adsorption and charging for image formation of the recording medium P are both performed using the electrostatic adsorption means 20. However, a charging means may be provided separately from the electrostatic adsorption means.

The recording medium P charged by the electrostatic adsorption means 20 is transported to the position of the ejection head 30 to be described later by the transport belt 18. When doing so, the front edge of the recording medium P is detected by the recording medium position detection means 36, such as a photosensor, provided on an upstream side with respect to the ejection head 30, and a timing of ink ejection from the ejection head 30 is controlled with reference to a result of the detection.

In the image forming portion by the ejection head 30, a recording signal voltage is applied to the ejection head 30 by regarding the charge potential of the recording medium P as a bias, thereby ejecting ink (droplets) and forming an image on the recording medium P. Here, by providing a means for heating the transport belt 18 and increasing the temperature of the recording medium, fixation of the ink droplets ejected from the ejection head 30 on the print medium may be accelerated. In this case, it becomes possible to further suppress blurring and improve image quality. An image recording method used by the ejection head 30 will be described in detail later.

The recording medium P, on which an image has been formed, is discharged by the discharge means 22, is peeled off the transport belt 18 by the peeling means 24, and is transported to the fixing/transporting means 26.

In this embodiment, the discharge means 22 includes a corotron discharger 22*a*, an AC power supply 22*b* connected to the corotron discharger 22*a*, a DC high voltage power supply 22*c* connected to the AC power supply 22*b*, with a terminal of the DC high voltage power supply 22*c* on one side being grounded. The discharge means 22 of the illustrated example uses a so-called AC corotron discharger that uses the corotron discharger 22*a* and the AC power supply 22*b*, although it is possible to use various other means and methods such as a scorotron discharger, a solid discharger, and a discharge needle, for instance. In addition, a construction using a conductive roller is suitably used like in the case of the electrostatic adsorption means 20 described above. Also, as the peeling means 24, it is possible to use various known techniques such as a peeling blade, a reverse rotation roller, and an air knife.

The recording medium P peeled off the transport belt 18 is sent to the fixing/transporting means 26, which then fixes the image formed by the ink. In this embodiment, as the fixing/transporting means 26, a roll pair composed of a heat roll 26*a* and a transport roll 26*b* is used. With this construction, during the transport of the recording medium P by the fixing/transporting means 26, fixing of the image formed on the recording medium P is achieved through contact heating. In the present invention, however, a fixing means for performing the fixing may be provided separately from the transport means. The fixing/transporting means 26 and other usable fixing means will be described in detail later.

It should be noted here that it is preferable that the image forming surface of the recording medium P is held so as not to contact anything at least in a process from the image formation by the ink from the ejection head 30 to the fixing by the fixing/transporting means 26.

The moving speed of the recording medium P at the time of the fixing by the fixing/transporting means 26 is not specifically limited and it does not matter whether the moving speed is the same as or is different from the transport speed by the transport belt 18 at the time of image formation. When the moving speed of the recording medium P is different from the transport speed at the time of image formation, it is also preferable that a speed buffer is provided for the recording medium P immediately before the fixing/transporting means 26.

The recording medium P, on which the image has been fixed, is discharged onto a not-shown discharged sheet stocker while being guided by the guide 28.

Next, an image forming (drawing) means in the ink jet printer 10 will be described.

As described above, the image forming means of the ink jet printer 10 includes the ejection head 30 for ejecting ink, the ink circulation system 32 that supplies the ink to the ejection head 30 and recovers the ink from the ejection head 30, the head driver 34 that drives the ejection head 30 in accordance with image data from a not-shown external apparatus such as a computer or a raster image processor (RIP), the recording medium position detection means 36 for detecting the recording medium P in order to determine an image formation (recording) position on the recording medium P, and the recording position control means 38 for controlling the position of the ejection head 30.

Figure 2:
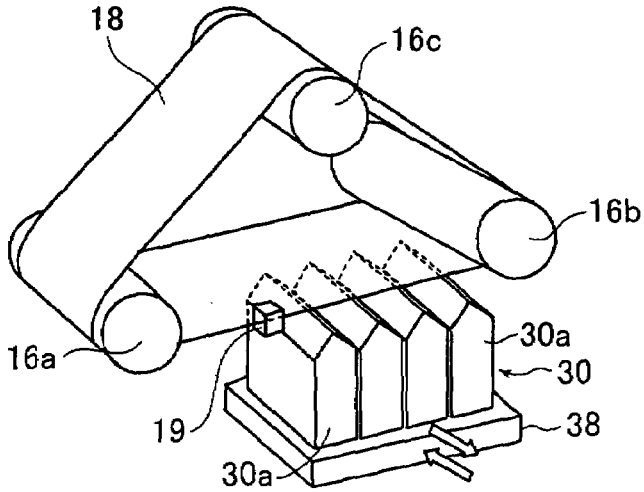
FIG. 2 is a schematic perspective view showing an ejection head and a recording medium transport means on the periphery of the ejection head.

FIG. 2 is a schematic perspective view showing the ejection head 30, the recording position control means 38, and the transport means for the recording medium P on the periphery thereof.

The ejection head 30 includes ejection heads 30*a* for four colors of cyan (C), magenta (M), yellow (Y), and black (K) for recording a full-color image, and forms an image on the recording medium P transported by the transport belt 18 at a predetermined speed by ejecting ink supplied by the ink circulation system 32 as ink droplets in accordance with signals from the head driver 34. The ejection heads 30*a* for the respective colors are arranged along a traveling direction of the transport belt 18. Note that a concrete head construction of the ejection heads 30*a* usable in the present invention will be described later.

The ink jet printer 10 of the illustrated example performs main scanning by transporting the recording medium P with respect to the ejection head 30 using the transport belt 18. With this construction, the ink jet printer 10 of the illustrated example becomes capable of performing image formation (drawing) at a higher speed as compared with a case of a commercially available ink jet printer that serially scans its ejection head.

As the each ejection head 30*a* for the each color of the ejection head 30, it is possible to use a multi-channel head in which multiple nozzles (each nozzle corresponds to one unit of the ejection head that ejects ink droplets) are arranged at predetermined intervals in a predetermined area in a direction (widthwise direction) orthogonal to the transport direction of the recording medium P or also in a direction (transport direction) parallel to the transport direction of the recording medium P. Alternatively, it is possible to use a full-line head in which nozzles are arranged in an entire area in the widthwise direction of the recording medium P.

When the multi-channel head is used as the ejection head 30 (the ejection head 30*a*), the main scanning is performed by transporting the recording medium P with respect to the ejection head 30 through rotation of the transport belt 18 under a state where the recording medium P is held on the transport belt 18. Also, sub scanning is performed by continuously moving the ejection head 30 in the widthwise direction of the transport belt 18 or by sequentially (intermittently) moving the ejection head-30 in the widthwise direction each time the transport belt 18 makes one rotation. In this manner, an image is formed on the recording medium P. Consequently, in order to form an image on the entire area of the recording medium P, the transport belt 18 is rotated multiple times while holding the recording medium P, that is, the main scanning is performed multiple times. Note that an sub scanning method of the ejection head 30 in this case may be selected as appropriate in accordance with the relation between the nozzle density of the ejection head 30 and drawing resolution, an interlace method, and the like.

On the other hand, when the full-line head is used as the ejection head 30, an image-is formed on the entire area of the recording medium P merely by transporting the recording medium P held on the transport belt 18 with respect to the ejection head 30 and having the recording medium P pass by the ejection head 30 once, that is, by performing scanning only once.

After an image is formed on the entire area of the recording medium P by the ejection head 30 (the multi-channel head or the full-line head) in this manner, the recording medium P is nipped and transported by the fixing/transporting means 26, during which the formed image is fixed by the fixing/transporting means 26.

It should be noted here that in the above description, when the ejection head 30 uses the multi-channel head, the main scanning is performed by transporting the recording medium P in a transport direction of the transport belt 18 using the transport belt 18 and the sub scanning is performed by moving the ejection head 30 in the widthwise direction of the transport belt 18, that is, in a direction approximately orthogonal to the main scanning direction. Also, when the ejection head 30 uses the full-line head, the entire surface of the recording medium P is scanned by transporting the recording medium P in the transport direction of the transport belt 18 using the transport belt 18. However, the present invention is not limited to this and any other scanning method may be used so long as it is possible to scan the entire surface of the recording medium P with the ejection head 30 by relatively moving the recording medium P and the ejection head 30. For instance, the main scanning may be performed by moving the ejection head 30 in the widthwise direction of the transport belt 18 and the sub scanning may be performed by transporting the recording medium P using the transport belt 18. Alternatively, the main scanning and the sub scanning may be performed by transporting the recording medium P in the transport direction of the transport belt 18 and moving the transport belt 18 in the widthwise direction of the transport belt 18 while fixing the ejection head 30. Still alternatively, the recording medium P may be held on a holding means at a predetermined position (for instance, the recording medium P is stationarily held on the transport belt 18 stopped at a predetermined position) and the entire surface of the recording medium P may be scanned by one-dimensionally moving the ejection head 30 (in the case of the full-line head) or by two-dimensionally moving the ejection head 30 (in the case of the multi-channel head).

Next, in order to have ink, whose amount is sufficient for ink ejection, flow through ink flow paths 90 (see FIGS. 3, 4A, and 4B, for instance) of the ejection heads 30*a* for respective colors of the ejection head 30, the ink circulation system 32 includes an ink circulation apparatus 32*a* including ink tanks, pumps, replenishing ink tanks (not shown), and the like for respective four colors (C, M, Y, and K). The ink circulation system 32 also includes an ink supplying system 32*b* that includes ink supplying paths composed of ink distribution pipe systems for respective colors for supplying the ink in respective colors from the ink tanks of the ink circulation apparatus 32*a* to the respective ink flow paths 90 (to the right side in FIG. 4A, for instance) of the ejection heads 30*a* for respective colors of the ejection head 30. The ink circulation system 32 further includes an ink recovery system 32*c* that includes ink recovery paths composed of ink distribution pipe systems for respective colors for recovering the ink from the ink flow paths 90 (from the left side in FIG. 4A) of the ejection heads 30*a* for the respective colors of the ejection head 30 to the ink circulation apparatus 32*a*.

The ink circulation system 32 is not specifically limited so long as it is possible to circulate the ink by supplying the ink from the ink tanks of the ink circulation apparatus 32*a* to the ejection head 30 through the ink supplying system 32*b* independently of respective colors and recovering the ink from the ejection head 30 to the ink tanks through the ink recovery system 32*c* independently of respective colors. Each ink tank reserves the ink in a corresponding color for image recording, with the reserved ink being pumped up by a pump and sent to the ejection head 30. The ejection of the ink from the ejection head 30 lowers the concentration of the ink circulated by the ink circulation system 32, so that it is preferable that the ink circulation system 32 is constructed so that the ink concentration is detected using an ink concentration detector and the ink is refilled as appropriate from the replenishing ink tanks in accordance with the detected ink concentration. With this construction, it becomes possible to maintain the ink concentration in a predetermined range.

Also, it is preferable that the ink tanks are each provided with a stirring apparatus for suppressing deposition/coagulation of a solid component of the ink and an ink temperature management apparatus for suppressing changes in temperature of the ink. This is because if the temperature management is not performed, the ink temperature changes due to changes in environmental temperature or the like and therefore there occur changes in physical properties of the ink and in size of dots, so that there is a possibility that it may become impossible to form high-quality images with stability.

As the stirring apparatus, it is possible to use a rotary blade, an ultrasonic transducer, a circulation pump, or the like.

As the ink temperature control apparatus, it is possible to use various known methods such as a method with which a heat generation element or a cooling element, such as a heater or a Peltier element, is provided for the ejection head 30, the ink tanks, the ink distribution pipe systems, or the like and the ink temperature is controlled using a temperature sensor such as a thermostat. When the temperature control apparatus is arranged in the ink tanks, it is preferable that the temperature control apparatus is arranged together with a stirring apparatus, thereby making it possible to maintain a temperature uniform in the tank. The stirring apparatus, with which a temperature in each tank is maintained uniform, may be used also as the stirring apparatus that suppresses the deposition/coagulation of the solid component of the ink.

The head driver 34 receives image data from a system control portion (not shown) that receives image data from an external apparatus and performs various processing on the image data, and drives the ejection head 30 based on the image data. The system control portion color-separates the image data received from the external apparatus such as a computer, an RIP, an image scanner, a magnetic disk apparatus, or an image data transmission apparatus. The system control portion then performs division computation into an appropriate number of pixels and an appropriate number of gradations, performs screening processing, performs computation of a halftone dot area ratio on the color-separated data, and outputs head drive data corresponding to the image data to the head driver 34. The head driver 34 drives the ejection head 30 (ejection heads 30*a* for respective colors) in accordance with the head drive data.

Also, the system control portion controls movement of the ejection head 30 (recording position control means 38) and timings of ink ejection by the ejection head 30 in accordance with transport timings of the recording medium P by the transport belt 18. The ejection timings are controlled using an output from the recording medium position detection means 36 or an output signal from an encoder or a photo interpreter arranged for the transport belt 18 or a drive means of the transport belt 18.

The recording medium position detection means 36 detects the recording medium P transported to a position at which the ejection head 30 ejects ink droplets, and may be any known detection means such as a photosensor.

The recording position control means 38, on which the ejection head 30 is mounted/fixed, moves the ejection head 30 in the widthwise direction of the transport belt 18 and adjusts an image forming position onto the recording medium P in the widthwise direction. That is, in order to perform fine adjustment of image formation at a predetermined position on the recording medium P and to perform sub scanning when the multi-channel head is used as the ejection head 30, the recording position control means 38 moves the ejection head 30 in accordance with the position of the transport belt 18 detected by the transport belt position detection means 19 and an image signal from the head driver 34.

Next, the fixing/transporting means 26, the collecting means for collecting air in proximity to the fixing/transporting means 26, and the removing means for removing the solvent from the collected air will be described in detail.

As described above, in this embodiment, a roll pair composed of the heat roll 26*a* and the transport roll 26*b* is used as the fixing/transporting means 26. The heat roll 26*a* is heated to a predetermined fixing temperature at which the solvent of the ink forming an image on the recording medium P is vaporized and the color particles thereof are fixed. The heat roll 26*a* heats the recording medium P in contact therewith while transporting the recording medium P, thereby vaporizing the ink solvent and fixing the color particles on the recording medium P.

In this embodiment, the heat roll 26*a* is brought into contact with an image forming surface of the recording medium P, although the heating of the recording medium P by the fixing/transporting means 26 may be performed from a non-image forming surface of the recording medium P or from both surfaces thereof. Also, the fixing/transporting means 26 may be a pair of heat rolls or a combination of a heat roll and a known transport means such as a nip roll or a transport belt.

It should be noted here that as described above, in the present invention, the fixing/transporting means 26 may be constructed so as to include a transport means composed of a transport roll pair and a fixing means separately. In this case, aside from the heat roll described above that performs fixing through contact heating, it is possible to use other known heat-fixing means. For instance, it is possible to vaporize the ink solvent and fix the color particles on the recording medium P by heating the recording medium P in a non-contact manner using an irradiation apparatus (such as an infrared ray lamp, a halogen lamp, or a xenon flash lamp), a heater, or the like. Also, it is possible to use various general heat-fixing means such as a hot-air fixing means using a heater.

In the case of heat-fixing through contact or non-contact heating, when coated paper or laminated paper is used as the recording medium P, there occurs a phenomenon called "blister" where moisture in the paper is abruptly vaporized due to a sudden increase in temperature and projections and depressions occur to the paper surface. In order to prevent this phenomenon, it is preferable that the paper temperature is gradually increased by, for instance, arranging multiple fixing devices (heating devices) and changing at least one of the electric power supply to each fixing device and a distance from each fixing device to the recording medium P.

The ink jet printer 10 includes the hood 40 and the duct 42 as a means for collecting solvent-containing air and includes the solvent removing device 44 as a means for removing the solvent. Also, a set of the hood 40, the duct 42, and the solvent removing device 44 function as a suction means for sucking and collecting the solvent-containing air.

The hood 40 is a suction opening of the solvent removing device 44 and is connected to the solvent removing device 44 through the duct 42. The hood 40 is a hermetically shielding means that is provided so as to enclose a region (such as a region in proximity to the fixing/transporting means 26), in which a large quantity of solvent vapor is generated, as much as possible. It is preferable that the hood 40 is provided so as to surround at least a region on the image recording surface side of the recording medium P in proximity to a contact portion between the fixing/transporting means 26 and the recording medium P, in particular, a region in proximity to the heat roll 26*a*.

As described above, the solvent in the ink is vaporized through heating of the recording medium P by the heat-fixing means, such as the heat roll 26*a*, of the fixing/transporting means 26. Therefore, the atmosphere in proximity to the heat-fixing means, such as the heat roll 26*a*, of the fixing/transporting means 26 (in particular, in a downstream portion with respect to the contact portion with the recording medium P) is filled with high-temperature air containing a large quantity of solvent. In order to make it possible to collect most of the solvent-containing air, it is preferable that the hood 40 is provided so that the heat-fixing means, such as the heat roll 26*a*, of the fixing/transporting means 26, that is, the heated portion of the recording medium P is hermetically sealed as much as possible, that is, the heating-fixing means or the heated portion is shielded as much as possible. Note that in order to prevent corrosion of the hood 40 and the duct 42 by the collected high-temperature solvent-containing air, it is preferable that these components 40 and 42 are made heat resistant and solvent resistant.

By approximately shielding the heated portion of the recording medium P with the hood 40, it becomes possible to prevent a problem that the ejection head 30 is dried by an air flow caused by the collecting means or heat generated by the fixing/transporting means 26 and to suppress clogging of the ejection head 30 and variations in physical properties of the ink due to drying of the ink. As a result, there is also provided an effect that it becomes possible to perform ink ejection from the ejection head 30 with stability and to form an image having high image quality.

The solvent-containing air suctioned from the hood 40 is sent to the solvent removing device 44 through the duct 42.

Then, the solvent removing device 44 removes the solvent from the suctioned solvent-containing air. For this purpose, the solvent removing device 44 is provided with a solvent absorption material and removes the solvent in the solvent-containing air by adsorbing the solvent in the suctioned solvent-containing air using the solvent absorption material. As the solvent absorption material, it is possible to suitably use various kinds of activated carbon.

It should be noted here that the solvent removing device 44 may be provided with a cooling device and the solvent in the solvent-containing air may be concentrated and removed through cooling of the collected solvent-containing air using the cooling device.

The solvent-containing air collecting means and the solvent removing means according to the present invention perform solvent removal by selectively collecting air containing a large quantity of solvent in the manner described above, so that the solvent collection efficiency is increased and therefore it becomes possible to achieve reductions in apparatus size and power consumption. Also, the solvent absorption material provided for the solvent removing device 44 is prevented from being unnecessarily degraded due to absorption of water vapor or the like, which makes it possible to improve maintainability. Also, the amount of water vapor absorbed by the solvent absorption material is suppressed, which facilitates extraction and reuse of the absorbed solvent.

It should be noted here that the method for collecting the solvent-containing air is not limited to the method with which the solvent-containing air is suctioned by the solvent removing device 44. For instance, the solvent-containing air collection may be performed using a method with which air is blown by a blowing means such as a blower for blowing air in proximity to the fixing/transporting means 26, in particular, the air in proximity to the heat-fixing means such as the heat roll 26*a*, into the hood 40. Alternatively, these methods may be used in combination.

Also, it is preferable that after removal of the solvent, the high-temperature dry air (dry gas) collected into the solvent removing device 44 is sent to a position on a downstream side of the ejection head 30 and on an upstream side of the fixing/transporting means 26 on the transport path of the recording medium P, and is used for preliminary heating of fixing of the image formed on the recording medium P. Alternatively, it is also preferable that the heat energy of the high-temperature air obtained by the solvent removing device 44 is extracted by a heat exchanger and is used to preliminarily heat the recording medium P.

With this construction, it also becomes possible to reduce an amount of energy consumed by the fixing/transporting means 26 for heating. Further, it becomes possible to shorten a time taken by the fixing/transporting means 26 for heating, which makes it possible to improve a processing speed of the ink jet printer 10.

It is also preferable to use the high-temperature dry air which was collected in the solvent removing device 44 and from which the solvent was removed, or the heat energy thereof as the heating energy for fixing in the fixing/transporting means 26.

It should be noted here that when an enormous amount of recording is continuously performed with the ink jet printer 10, when a preliminary heating means for fixing is provided in the ink jet printer 10, or when a means for heating the belt 18 is provided in the ink jet printer 10, for instance, there is a case where the ink solvent is vaporized to some extent in proximity to the ejection head 30, the preliminary heating means, or the like. A small amount of the solvent vapor generated in these portions is allowable as far as it is not discharged to the outside of the ink jet printer 10, and it is preferable that the ejection portion of the ejection head 30 is saturated with solvent vapor so as to prevent drying of ink. However, if it is required to also collect the solvent vaporized in this manner, it is of course possible to use a conventional solvent collecting device, which collects air in the entire region inside the ink jet printer 10 and remove the solvent in the collected air, in combination with the solvent-containing air collecting means and the solvent removing means described above. Even in this case, it is possible to reduce the apparatus size as compared with a conventional apparatus because the supplemental solvent collecting device to be used here commonly is not required to achieve a high collection ratio.

As the ejection head 30 of the ink jet printer 10 shown in FIG. 1, it is possible to use various ink jet heads based on various known ink jet systems. However, it is particularly suitable that the ejection head 30 is a so-called electrostatic ink jet head that is a head based on an electrostatic ink jet system where color particles in ink are concentrated and ink droplets containing the concentrated color particles are caused to adhere on the recording medium P mainly by means of an electrostatic attraction force from the recording medium or a counter electrode provided on the back surface side of the recording medium.

The electrostatic ink jet head receives application of a predetermined voltage to each ejection electrode in accordance with image data and ejects ink by means of an electrostatic force onto the recording medium held at a predetermined bias potential between the ejection electrodes or toward a counter electrode on the back surface side of the recording medium, thereby recording an image corresponding to the image data on the recording medium.

Next, a concrete head construction of the electrostatic ink jet head (ejection head 30*a*) that controls ejection of ink containing charged color particles by means of an electrostatic force will be described with reference to FIGS. 3, 4A, 4B, 5A, 5B, and 5C.

Figure 3:
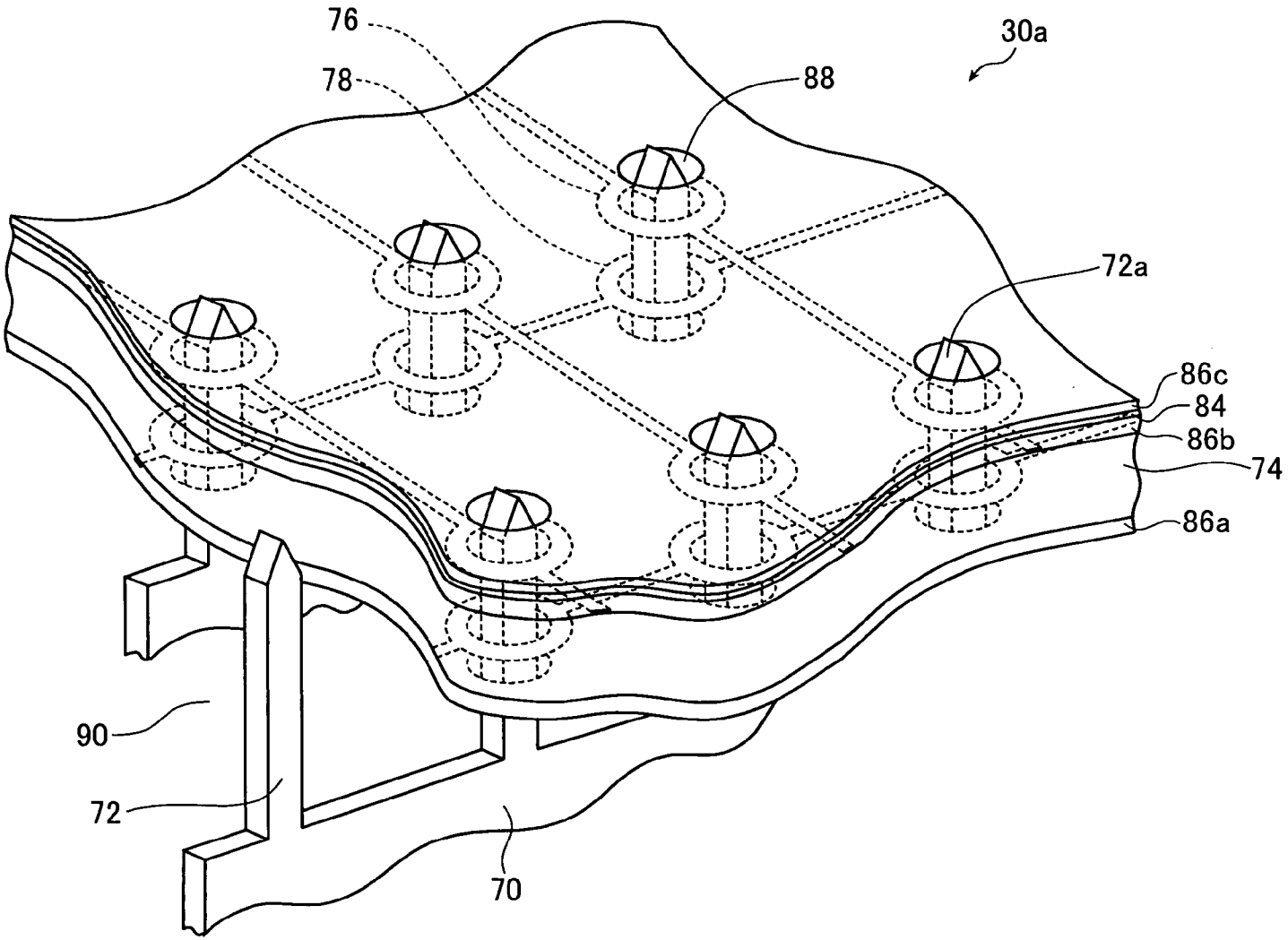
FIG. 3 is a schematic perspective view showing an example construction of the ejection head.
Figure 4A:
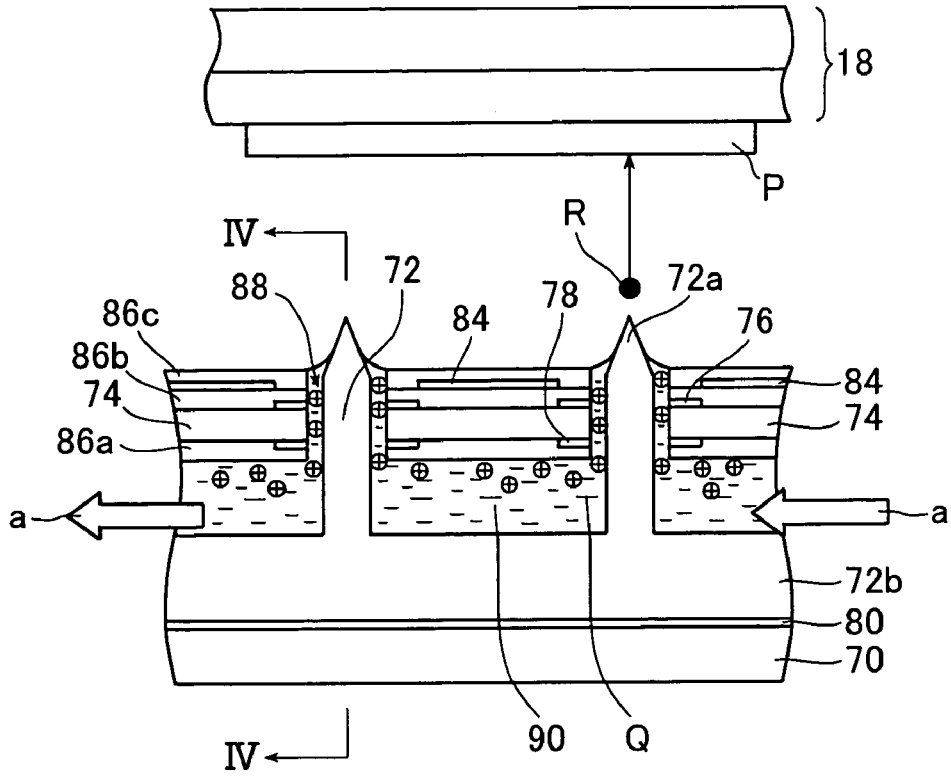
FIG. 4A is a schematic cross-sectional view showing a part of the ejection head shown in FIG. 3.
Figure 4B:
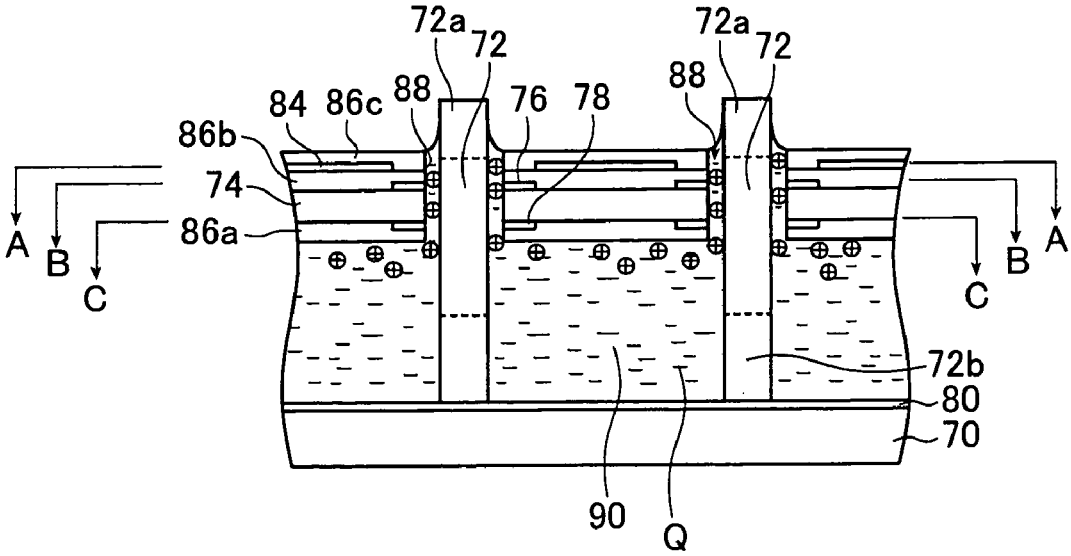
FIG. 4B is a schematic cross-sectional view taken along the line IV—IV in FIG. 4A.
Figure 5A:
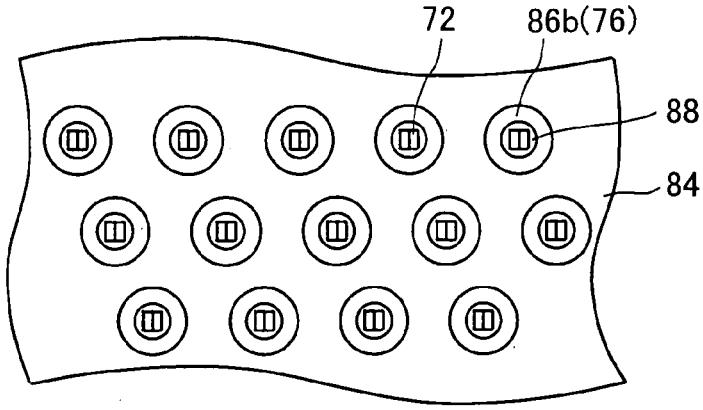
FIG. 5A is an arrow view taken along the line A—A in FIG. 4B.
Figure 5B:
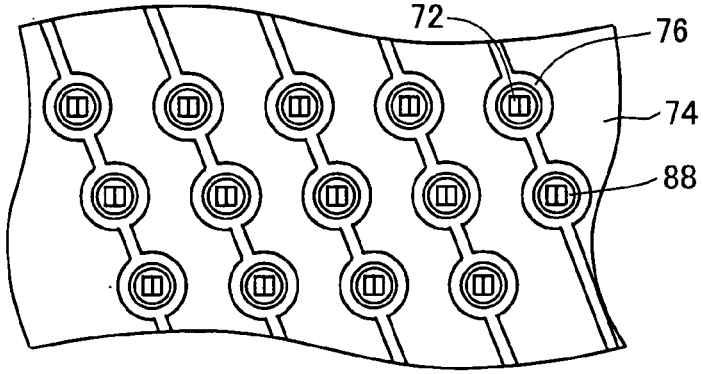
FIG. 5B is an arrow view taken along the line B—B in FIG. 4B.
Figure 5C:
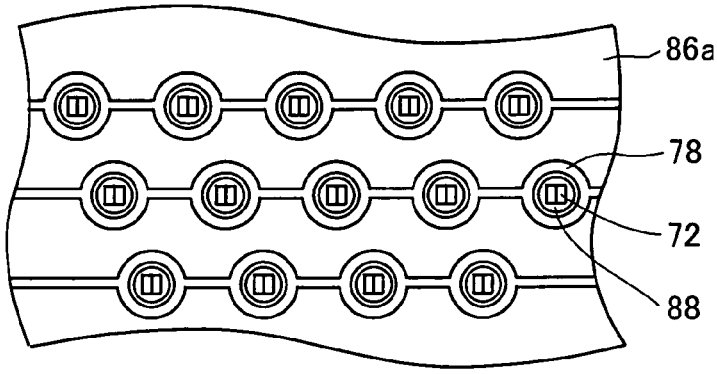
FIG. 5C is an arrow view taken along the line C—C in FIG. 4B.

FIG. 3 is a partial schematic perspective view showing an example construction of ejection heads 30*a* for respective colors of the ejection head 30 used for the ink jet printer 10. FIG. 4A is a schematic cross-sectional view showing a part of the ejection head 30*a* shown in FIG. 3. FIG. 4B is a schematic cross-sectional view taken along line IV—IV in FIG. 4A. FIGS. 5A, 5B, and 5C are arrow views each taken along line A—A, line B—B, and line C—C in FIG. 4B (penetration hole portions are viewed from upper side).

The ejection head 30*a* shown in these drawings is an electrostatic ink jet head having ejection electrodes of a two-layered electrode structure and records an image corresponding to image data on the recording medium P by ejecting ink Q containing color particles, such as charged pigments (fine particle component of toner or the like, for instance), by means of an electrostatic force. For this purpose, the ejection head 30*a* includes a head substrate 70, ink guides 72, an insulative substrate 74, first drive electrodes 76 and second drive electrodes 78 constituting ejection electrodes, and a floating conduction plate 80. The ejection head 30*a* having this construction is arranged so as to oppose the transport belt 18 that supports the recording medium P serving as a counter electrode.

In the ejection head 30*a* of the illustrated example, the ejection electrodes form a two-layered electrode structure where the insulative substrate 74 is sandwiched between the first drive electrodes 76 arranged on the upper surface of the insulative substrate 74 and the second drive electrodes 78 arranged on the lower surface thereof in the drawings.

The ejection head 30*a* of the illustrated example also includes an insulation layer 86*a* covering the lower side (lower surfaces) of the second drive electrodes 78, an insulation layer 86*b* covering the upper side (upper surfaces) of the first drive electrodes 76, a sheet-like guard electrode 84 arranged on the upper side of the first drive electrodes 76 with the insulation layer 86*b* in-between, and an insulation layer 86*c* covering the upper surface of the guide electrode 84.

In the ejection head 30*a* of the illustrate example, each ink guide 72 is made of an insulative resin flat plate having a predetermined thickness and having a projection-like tip end portion 72*a*, and multiple ink guides 72 are formed in one base portion 72*b*. Also, each ink guide 72 is arranged on the head substrate 70 at the position of each individual electrode unit. Here, an individual electrode unit is a set of the first drive electrode 76 and the second drive electrode 78 at one ejection portion (one nozzle). Further, in a layered product of the insulation layer 86*a*, the insulative substrate 74, and the insulation layers 86*b* and 86*c*, through holes 88 are established at positions corresponding to the arrangement of the ink guides 72. The ink guides 72 are inserted into the through holes 88 from the insulation layer 86*a* side so that the tip end portions 72*a* of the ink guides 72 project from the insulation layer 86*c*. Note that a slit serving as an ink guide groove may be formed in the tip end portion 72*a* of each ink guide 72 in the top-bottom direction on the paper plane of the drawing, thereby promoting supply of the ink Q and concentration of the charged color particles in the ink Q to the tip end portion 72*a*.

The tip end portion 72*a* of each ink guide 72 is formed in an approximately triangular shape (or an approximately trapezoid shape) that is gradually narrowed in a direction toward the recording medium P (transport belt 18) side. Also, it is preferable that a metal has been vapor-deposited on the tip end portion (extreme tip end portion) 72*a* of each ink guide 72 from which the ink Q is to be ejected. Although there occurs no problem even if the metal vapor-deposition is not carried out for the tip end portion 72*a* of the ink guide 72, it is preferable that the metal vapor-deposition is conducted because the effective dielectric constant of the tip end portion 72*a* of the ink guide 72 becomes large as a result of the metal vapor-deposition and there is provided an effect that it becomes easy to generate an intense electric field. Note that the shape of the ink guides 72 is not specifically limited so long as it is possible to concentrate the ink Q (in particular, the charged color particles in the ink Q) in the tip end portions 72*a* through the through holes 88 of the insulative substrate 74. For instance, the shape of the tip end portions 72*a* may be changed as appropriate into a shape other than the projection, such as a conventionally known shape.

The head substrate 70 and the insulation layer 86*a* are arranged so as to be spaced apart from each other by a predetermined distance, and an ink flow path 90 functioning as an ink reservoir (ink chamber) for supplying the ink Q to the ink guides 72 is formed between the head substrate 70 and the insulation layer 86*a*. Note that the ink Q in the ink flow path 90 contains color particles charged to the same polarity as the voltages applied to the first drive electrodes 76 and the second drive electrodes 78, and is circulated in a predetermined direction (in the example shown in FIGS. 4A and 4B, in the direction of arrow "a" from the right to the left) in the ink flow path 90 at a predetermined speed (ink flow of 200 mm/s, for instance) by the ink circulation mechanism (see the ink circulation system 32 shown in FIG. 1, for instance) at the time of recording. Hereinafter, a case where the color particles in the ink are positively charged will be described as an example.

As shown in FIG. 3, the first drive electrodes 76 and the second drive electrodes 78 are arranged on the upper surface of the insulative substrate 74 and the lower surface thereof, respectively, and they are circular electrodes surrounding the through holes 88 bored in the insulative substrate 74. Note that the first drive electrodes 76 and the second drive electrodes 78 are not limited to the circular electrodes and may be changed into approximately circular electrodes, division-circular electrodes, parallel electrodes, or approximately parallel electrodes. The first drive electrodes 76 and the second drive electrodes 78, a part of which have the shape described above, are arranged in a matrix shape and form the two-layered electrode structure. Here, the multiple first drive electrodes 76 are connected to each other in a row direction (main scanning direction, for instance) and the multiple second drive electrodes 78 are connected to each other in a column direction (sub scanning direction, for instance).

When the first drive electrodes 76 in one row are set at a high-voltage level or under a floating (high-impedance) state and the second drive electrodes 78 in one column are set at a high-voltage level, that is, when both of one row and one column of the electrodes are set under an on-state, one individual electrode unit existing at an intersection of the row and the column is set under an on-state and ejects the ink. Note that ink ejection is not performed when one of the first drive electrodes 76 and the second drive electrodes 78 are set at a ground level. In this manner, the first drive electrodes 76 and the second drive electrodes 78 arranged in a matrix manner are matrix-driven. Accordingly, it becomes possible to significantly reduce the number of drivers (specified using reference numeral 34 in FIG. 1) for driving the first drive electrodes 76 and second drive electrodes 78, to miniaturize the driver, and to reduce its implementation area.

Meanwhile, the recording medium P charged to a voltage having a polarity that is opposite to the polarity of the charged color particles in the ink is arranged so as to oppose the ink guides 72 while being held on the transport belt 18. As described above, in this embodiment, the recording medium P is charged to a negative high voltage. Also, the front surface of the transport belt 18 holding the recording medium P is an insulative fluororesin surface and the back surface thereof is a conductive metallic surface, with the metallic surface being grounded through the conductive roller 16*a* (see FIG. 1).

The floating conduction plate 80 is arranged below the ink flow path 90 and is set under an electrically insulated state (high-impedance state). In the illustrated example, the floating conduction plate 80 is arranged on the upper surface of the head substrate 70.

At the time of recording of an image, the floating conduction plate 80 generates an induced voltage in accordance with the value of a voltage applied to each individual electrode unit and causes the color particles in the ink Q in the ink flow path 90 to migrate to the insulative substrate 74 side and to be concentrated in the ink Q. Accordingly, it is required that the floating conduction plate 80 is arranged on the head substrate 70 side with respect to the ink flow path 90. Also, it is preferable that the floating conduction plate 80 is arranged on an upstream side of the ink flow path 90 with respect to the position of the individual electrode unit. With this floating conduction plate 80, the concentration of the charged color particles in the upper layer in the ink flow path 90 is increased. As a result, it becomes possible to increase the concentration of the charged color particles in the ink Q passing through the through holes 88 to a predetermined level, to cause the charged color particles to be concentrated in the tip end portions 72*a* of the ink guides 72, and to maintain the concentration of the charged color particles in the ink Q ejected as ink droplets at a predetermined level.

In the ejection head 30*a* of this embodiment including the ejection electrodes of the two-layered electrode structure described above, the second drive electrodes 78 always receive application of a predetermined voltage (600 V, for instance) and the first drive electrodes 76 are switched between a ground state (off-state) and a high-impedance state (on-state) in accordance with image data, for instance. By doing so, ejection/non-ejection of the ink Q (ink droplets R) containing the color particles charged to the same polarity as the high-voltage level applied to the second drive electrodes 78 is controlled. That is, in the ejection head 30*a*, when one of the first drive electrodes 76 is set at the ground level (off-state), the electric field strength in proximity to the tip end portion 72*a* of an corresponding ink guide 72 remains low and ejection of the ink Q from the tip end portion 72*a* of the ink guide 72 is not performed. On the other hand, when one of the first drive electrodes 76 is set under the high-impedance state (on-state), the electric field strength in proximity to the tip end portion 72*a* of the corresponding ink guide 72 is increased and the ink Q concentrated in the tip end portion 72*a* of the ink guide 72 is ejected from the tip end portion 72*a* by means of an electrostatic force. When doing so, it is also possible to further concentrate the ink Q by selecting the condition.

In such a two-layered electrode structure, the first drive electrodes 76 are switched between the high-impedance state and the ground level, so that no large electric power is consumed for the switching. Therefore, according to this embodiment, even in the case of an ink jet head that needs to perform high-definition recording at a high speed, it becomes possible to significantly reduce power consumption.

It should be noted here that the ejection/non-ejection may be controlled by switching the first drive electrodes 76 between the ground level (off-state) and the high-voltage level (on-state) in accordance with image data. In the ejection head 30*a* of this embodiment, when one of the first drive electrodes 76 and the second drive electrodes 78 are set at the ground level, the ink ejection is not performed and, only when the first drive electrodes 76 are set under the high-impedance state or at the high-voltage level and the second drive electrodes 78 are set at the high-voltage level, the ink ejection is performed.

Also, in this embodiment, pulse voltages may be applied to the first drive electrodes 76 and the second drive electrodes 78 in accordance with image signals and the ink ejection may be performed when both of these electrodes are set at the high-voltage level.

It should be noted here that it does not matter whether the ink ejection/non-ejection is controlled using one or both of the first drive electrodes 76 and the second drive electrodes 78. However, it is preferable that when one of the first drive electrodes 76 and the second drive electrodes 78 are set at the ground level, the ejection of the ink Q is not performed and, only when the first drive electrodes 76 are set under the high-impedance state or at the high-voltage level and the second drive electrodes 78 are set at the high-voltage level, the ink ejection is performed.

Also, the recording medium P may be charged to −1.6 kV, for instance, and the ink ejection may be controlled so that the ink will not be ejected when at least one of the first drive electrodes 76 and the second drive electrodes 78 are set at a negative high voltage (−600 V, for instance) and the ink will be ejected only when both of the first drive electrodes 76 and the second drive electrodes 78 are set at the ground level (0V).

Also, according to this embodiment, the individual electrode units are arranged in a two-dimensional manner and are matrix-driven, so that it becomes possible to significantly reduce the number of row drivers for driving multiple ejection electrodes in the row direction and the number of column drivers for driving multiple ejection electrodes in the column direction. Therefore, according to this embodiment, it becomes possible to significantly reduce the implementation area and power consumption of a circuit for driving the two-dimensionally arranged individual electrode units. Also, according to this embodiment, it is possible to arrange the individual electrode units while maintaining relatively large margins, so that it becomes possible to extremely reduce a danger of discharging between the individual electrode units and to cope with both of high-density implementation and high voltage driving with safety.

It should be noted here that in the case of an ejection head, such as the electrostatic ejection head 30*a* described above, that uses ejection electrodes of the two-layered electrode structure composed of the first drive electrodes 76 and the second drive electrodes 78, when the individual electrode units are arranged at a high density, an electric field interference may occur between adjacent individual electrode units. Therefore, it is preferable that, like in this embodiment, the guard electrode 84 is provided between the first drive electrodes 76 of adjacent individual electrode units and the electric lines of force to adjacent ink guides 72 are shielded by the guard electrode 84.

The guard electrode 84 is arranged in spaces between the first drive electrodes 76 of adjacent individual electrode units and suppresses the electric field interferences between the ink guides 72 serving as ejection portions of the adjacent individual electrode units. FIGS. 5A, 5B, and 5C are respectively arrow views taken along the lines A—A, B—B, and C—C in FIG. 4B. As shown in FIG. 5A, the guard electrode 84 is a sheet-like electrode such as a metal plate that is common to every individual electrode unit, and holes are bored in the guard electrode 84 in portions corresponding to the first drive electrodes 76 (respective individual electrode units two-dimensionally arranged) formed around the through holes 88 (also see FIGS. 4A and 4B). Note that in this embodiment, the reason why the guard electrode 84 is provided is that if the individual electrode units are arranged at a high density, there is a case where an electric field generated by an individual electrode unit is influenced by the states of electric fields generated by its adjacent individual electrode units and therefore the size and drawing position of a dot ejected from the ejection portion (the nozzle) fluctuate and recording quality is adversely affected.

By the way, the upper side of the guard electrode 84 shown in FIGS. 4A and 4B is covered with the insulation layer 86*c* except for the through holes 88 and the insulation layer 86*b* is disposed between the guard electrode 84 and the first drive electrodes 76, thereby insulating the electrodes 84 and 76 from each other. That is, the guard electrode 84 is arranged between the insulation layer 86*c* and the insulation layer 86*b* and the first drive electrodes 76 are arranged between the insulation layer 86*b* and the insulative substrate 74.

That is, as shown in FIG. 5B, on the upper surface of the insulative substrate 74, that is, between the insulation layer 86*b* and the insulative substrate 74 (see FIGS. 4A and 4B), the first drive electrodes 76 of the respective individual electrode units formed around the through holes 88 are two-dimensionally arranged and are connected to each other in the row direction.

Also, as shown in FIG. 5C, on the upper surface of the insulation layer 86*a* (that is, on the lower surface of the insulative substrate 74), that is, between the insulation layer 86*a* and the insulative substrate 74 (see FIGS. 4A and 4B), the second drive electrodes 78 of the respective individual electrode units formed around the through holes 88 are two-dimensionally arranged and are connected to each other in the column direction.

Also, in this embodiment, in order to shield a repulsive electric field from the ejection electrode (drive electrode) of each individual electrode unit (a repulsive electric field from each first drive electrode 76 and each second drive electrode 78) toward the ink flow path 90, a shield electrode may be provided on the flow path side of the first drive electrode 76 and the second drive electrode 78.

Further, in the ejection head 30*a* of this embodiment, the floating conduction plate 80 is provided which constitutes the undersurface of the ink flow path 90 and causes the positively charged ink particles (charged particles, that is, electrified fine particle component) in the ink flow path 90 to migrate upwardly (that is, toward the recording medium P side) by means of induced voltages generated by pulse-like ejection voltages applied to the first drive electrodes 76 and the second drive electrodes 78. Also, an electrically insulative coating film (not shown) is formed on a surface of the floating conduction plate 80, thereby preventing a situation where the physical properties and-components of the ink are destabilized due to charge injection into the ink or the like. It is preferable that the electric resistance of the insulative coating film is set at $10^{12}$ Ω·cm or higher, more preferably at $10^{13}$ Ω·cm or higher. Also, it is preferable that the insulative coating film is corrosion resistant to the ink, thereby preventing a situation where the floating conduction plate 80 is corroded by the ink. Further, the floating conduction plate 80 is covered with an insulation member from its bottom side. With this construction, the floating conduction plate 80 is completely electrically insulated and floated.

Here, at least one floating conduction plate 80 is provided for each unit of the head (the ejection heads 30*a*). That is, in the ejection heads 30*a* for C, M, Y, and K, each head is provided with at least one floating conduction plate 80 and the ejection heads 30*a* for C and M will never share the same floating conduction plate.

In this embodiment, the circular electrodes are provided as the first drive electrodes 76 and the second drive electrodes 78 of the respective individual electrode units and these electrodes are connected to each other in the row direction and the column direction. However, the present invention is not limited to this and all of the individual electrode units may be separated from each other and driven independently of each other. Alternatively, one of the first drive electrodes 76 and the second drive electrodes 78 may be set as a sheet-like electrode common to every individual electrode unit (holes are bored in portions corresponding to the through holes 88).

Also, in this embodiment, the ejection electrodes are arranged so as to form the two-layered electrode structure composed of the first drive electrodes 76 and the second drive electrodes 78. However, the present invention is not limited to this and the ejection electrodes may be arranged so as to form a mono-layered electrode structure. In the case of the mono-layered electrode structure, it does not matter on which surface of the insulative substrate 74 the ejection electrodes are arranged, although it is preferable that the ejection electrodes are provided on the recording medium P side thereof.

Next, the ink used in the ink jet printer 10 of the present invention will be described.

The ink used in the present invention is oil-based ink where charged color particles (charged particles) having a particle size of around 0.1 to 5 μm are dispersed in a solvent (carrier liquid). Note that dispersion resin particles for improving fixability of an image after printing may be contained in the ink as appropriate together with the charged color particles. It is required that the carrier liquid is a dielectric liquid (non-aqueous solvent) having a high electric resistance that is $10^{9}$ Ω·cm or higher, preferably $10^{10}$ Ω·cm or higher. If a carrier liquid having a low electric resistance is used, the carrier liquid itself is electrified by charge injection by the voltages applied from the ejection electrodes, so that it becomes difficult to increase the concentration of the charged particles (charged fine particle component) and therefore concentration does not occur. Also, the carrier liquid having a low electric resistance is not suited for the present form because there is apprehension that electrical breakdown may occur between adjacent recording electrodes.

It is preferable that the relative permittivity of the dielectric liquid used as the carrier liquid is 5 or lower, more preferably 4 or lower, and still more preferably 3.5 or lower. By setting the relative permittivity in such a range, an electric field effectively acts on the charged particles in the dielectric liquid and migration easily occurs.

It should be noted here that it is preferable that the upper limit value of the inherent electric resistance of the dielectric liquid is around $10^{16}$ Ω·cm, and the lower limit value of the relative permittivity thereof is around 1.9.

The reason why it is preferable that the electric resistance of the dielectric liquid is in the range described above is that if the electric resistance is lowered, it becomes impossible to perform ejection of the ink under a low electric field with stability. On the other hand, the reason why it is preferable that the relative permittivity is in the range described above is that if the dielectric constant is increased, the electric field is weakened due to polarization of the solvent and therefore colors of dots formed are thinned or blurring occurs.

Preferred examples of the dielectric liquid of the present invention include straight-chain or branched aliphatic hydrocarbons, alicylic hydrocarbons, aromatic hydrocarbons, or halogen substituents of the hydrocarbons. For example, hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of American Mineral Spirits Company), a silicone oil (such as KF-96L, manufactured by Shin-Etsu Silicones), etc. may be used singly or as a mixture of those.

As to the color particles dispersed in the dielectric liquid (non-aqueous solvent), a colorant itself or the colorant contained in dispersion resin particles for improving fixability may be used. In the latter case, the color particles with pigments or the like are generally formed as resin-coated particles by coating pigments or the like with the resin material of the dispersion resin particles, or the color particles with dyes or the like are generally obtained as color particles by coloring the dispersion resin particles with dyes. As the colorant, it is possible to use any of pigments and dyes conventionally used in an ink jet ink composition, a printing (oil-based) ink composition, and an electrophotographic liquid developer.

The content of the ink particles (total content of the color particles and/or the dispersion resin particles) dispersed in the ink is preferably in a range of 0.5 to 30 wt % based on the total weight of the ink, more preferably in a range of 1.5 to 25 wt %, and still more preferably in a range of 3 to 20 wt %. If the content of the ink particles is lowered, there easily occurs a problem that, for instance, shortage of the density of a printed image occurs or affinity of the ink with the recording medium surface is hardly obtained and therefore it becomes difficult to obtain a firmly fixed image. On the other hand, if the content of the ink particles is increased, there occurs a problem that, for instance, it becomes difficult to obtain a uniform dispersion liquid or clogging of the ink easily occurs in the ejection head and therefore it becomes difficult to achieve stable ink ejection.

Pigments to be used as colorants may be inorganic pigments or organic pigments commonly employed in the field of printing technology. Specific examples thereof include, but are not particularly limited to, well-known pigments such as Carbon Black, Cadmium Red, Molybdenum Red, Chrome Yellow, Cadmium Yellow, Titanium Yellow, chromium oxide, Viridian, Cobalt Green, Ultramarine Blue, Prussian Blue, Cobalt Blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes to be used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Also, the average particle size of the ink particles, such as the color particles and/or dispersion resin particles, dispersed in the dielectric solvent is preferably in a range of 0.1 μm to 5 μm, more preferably in a range of 0.2 μm to 1.5 μm, and still more preferably in a range of 0.4 μm to 1.0 μm. The particle size was obtained using CAPA-500 (manufactured by HORIBA, Ltd.).

Here, it is preferable that the ink particles (color particles and/or dispersion resin particles) in the ink Q are positively or negatively charged particles.

It is possible to impart charge to the ink particles by appropriately using a technique of electrophotographic liquid developer. In more detail, it is possible to impart the charge to the ink particles using charge direction agent and/or other additives described in "Latest Systems for Electrophotographic Development, and Development and Application of Toner Materials" (pp. 139 to 148), "Fundamentals and Applications of Electrophotographic Techniques" (edited by Electrophotographic Society, pp. 497 to 505, CORONA PUBLISHING CO., LTD., 1988), "Electrophotography" (Yuji Harasaki, Vol. 16 (No.2), p. 44, 1977), and the like.

Also, the viscosity of the ink composition is preferably in a range of 0.5 to 5 mPa·sec, more preferably in a range of 0.6 to 3.0 mPa·sec, and still more preferably in a range of 0.7 to 2.0 mPa·sec. The color particles have electric charges and it is possible to use various charge control materials used for electrophotographic liquid developer as necessary. The charge amount thereof is preferably in a range of 5 to 200 μC/g, more preferably in a range of 10 to 150 μC/g, and still more preferably in a range of 15 to 100 μC/g. Also, there is a case where the electric resistance of the dielectric solvent changes due to addition of the charge control material. The charge direction agent is added so that the distribution factor P defined below becomes preferably 50% or higher, more preferably 60% or higher, and still more preferably 70% or higher.

$$P=100\times(\sigma1-\sigma2)/\sigma1$$

Here, σ1 is the electric conductivity of the ink composition and σ2 is the electric conductivity of a supernatant of the ink composition obtained with a centrifugal separator. The electric conductivity is a value measured using an LCR meter (AG-4311 manufactured by Ando Electric Co., Ltd.) and an electrode for liquid (LP-05 manufactured by Kawaguchi Electric Works Co., Ltd.) by applying a voltage of 5 V at a frequency of 1 kHz. Also, the centrifugation was performed using a high speed refrigerated microcentrifuge (SRX-201 manufactured by TOMY SEIKO CO., LTD.) for 30 minutes at a rotation speed of 14500 rpm under a temperature of 23° C.

With the ink composition described above, migration of the charged particles easily occurs and concentration is facilitated.

On the other hand, the electric conductivity al of the ink composition is preferably in a range of 100 to 3000 pS/cm, more preferably in a range of 150 to 2500 pS/cm, and still more preferably in a range of 200 to 2000 pS/cm. By setting the electric conductivity in this range, voltages applied to the ejection electrodes are prevented from becoming extremely high and therefore there is eliminated apprehension that electrical breakdown may occur between adjacent ejection electrodes. Also, the surface tension of the ink composition is preferably in a range of 15 to 50 mN/m, more preferably in a range of 15.5 to 45 mN/m, and still more preferably in a range of 16 to 40 mN/m. By setting the surface tension in this range, the voltages applied to the ejection electrodes are prevented from becoming extremely high and therefore there is prevented a situation where the head is soiled with ink leaking and spreading around the head.

In a conventional ink jet system, ink is caused to fly toward a recording medium by applying a force to the whole of the ink. In the present invention, however, the charged fine particle component (electrified color particles) that is a solid component dispersed in the carrier liquid mainly receives a force and is caused to fly toward the recording medium. As a result, it becomes possible to record an image on various recording media, such as a nonabsorbable film like a PET film, as well as plain paper. Also, it becomes possible to obtain an image having high image quality on various recording media by preventing blurring or flowing of the ink on the recording media.

In addition, the ink jet printer 10 of the illustrated example may include a spacing/contacting means for an ejection head 30. In this case, the system control portion (not shown) also performs control of a distance between the ejection head 30 and the recording medium P held on the transport belt 18 by using a mechanical distance control means, such as a bumping roller, or a control means which controls the position of the ejection head 30 or the transport belt 18 in accordance with a detection signal from an optical distance detector and the like. With this construction, during drawing, the ejection head 30 and the recording medium P are maintained so as to be spaced apart from each other by a predetermined distance, which enables formation of an image having high image quality. Also, the spacing/contacting means sets the ejection head 30 so as to be spaced apart from the transport belt 18 by at least 500 μm at the time of non-drawing. Here, the spacing/contacting operation of the spacing/contacting means may be performed in a sliding manner. Alternatively, the ejection head 30 may be fixed to an arm fixed to an axis and be moved in a pendulum manner through movement of the arm around the axis. By retracting the ejection head 30 at the time of non-drawing in this manner, the ejection head 30 is protected from physical destruction or soil, which makes it possible to achieve a long life span.

Also, the ink jet printer 10 of the illustrated example may be provided with a maintenance means, such as a cleaning means, as necessary. For instance, when an nonoperating state continues or when any problem occurs in image quality, a means for wiping the tip end of the ejection head 30 with a flexible brush, a cloth, or the like, a means for circulating only the ink solvent, a means for supplying only the ink solvent, a means for sucking the ejection portion while circulating the ink solvent, or another means may be used alone or in combination, thereby making it possible to maintain a favorable drawing state. Also, in order to prevent sticking or clogging of the ink, it is also effective to use a means for containing the ejection head 30 in a cover filled with ink solvent vapor, a means for cooling the head portion and suppressing vaporization of the ink solvent, or the like. Further, when the head is severely soiled, it is effective to forcibly suction the ink from the ejection portion, to forcibly insert jets of air, the ink, or the ink solvent from the ink flow paths, or to apply a voltage or an ultrasonic wave under a state where the head is immersed in the ink solvent, for instance. These methods may be used alone or in combination.

<Second Embodiment>

Next, a second embodiment of the ink jet recording apparatus of the present invention will be described.

Figure 6:
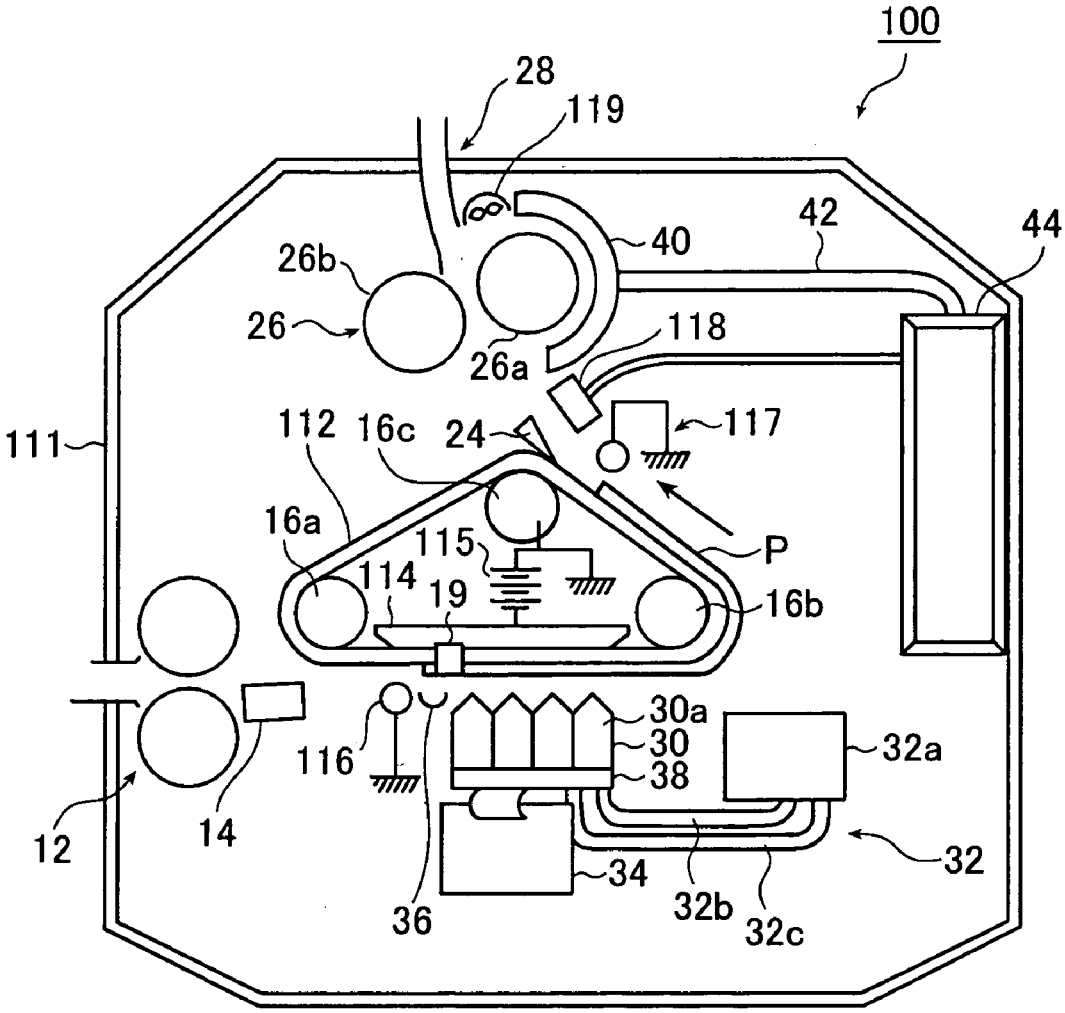
FIG. 6 is a schematic construction diagram showing a second embodiment of the ink jet recording apparatus according to the present invention.

An ink jet printer 100 shown in FIG. 6 has approximately the same construction and function as the ink jet printer 10 shown in FIG. 1. However, the ink jet printer 100 differs from the ink jet printer 10 in that the recording medium P is not directly charged for image formation, an insulative transport belt 112 is used, a conductive platen 114 is used as the counter electrode of an ejection head 30, an electrostatic adsorption means 116 and a discharge means 117 that are each a conductive roller are used, a preliminary heating means 118 is provided between the discharge means 117 and a fixing/transporting means 26, and a blowing means 119 is provided in addition to a hood 40 and a duct 42 as a solvent-containing air collecting means. In the following description, the same construction elements as in the ink jet printer 10 are given the same reference numerals and different construction elements will be mainly described.

The ink jet printer 100 shown in FIG. 6 includes the insulative transport belt 112, the conductive platen 114, the electrostatic adsorption means 116 using a conductive roller, and the discharge means 117 also using a conductive roller. Other construction elements are the same as those of the ink jet printer 10 shown in FIG. 1. These construction elements are provided in an enclosure 111.

A recording medium P is fed by a feed roller 12 from a not-shown stocker, is transported to the transport belt 112 while being guided by a guide 14, is electrostatically adsorbed on the transport belt 112 by the conductive platen 114 and the electrostatic adsorption means 116, and is transported to a position of the ejection head 30.

The transport belt 112 is stretched and moved by rollers 16*a*, 16*b*, and 16*c*, at least one of which is connected to a not-shown drive source. Also, the roller 16*c* arranged at a position opposing the discharge means 117 to be described later is grounded and also functions as a means for discharging the recording medium P.

The transport belt 112 moves the recording medium P in a main scanning direction at the time of image formation with ink ejected from the ejection head 30, and transports the recording medium P to the fixing/transporting means 26 after the image formation. The transport belt 112 is an endless belt made of a material that has superior dimensional stability and high endurance.

In this embodiment, the ink ejection by the ejection head 30 onto the recording medium P is performed through biasing to a negative high voltage using the conductive platen 114 provided between the roller 16*a* and the roller 16*b* so as to contact the back surface of the transport belt 112 as the counter electrode. Therefore, the transport belt 112 is made of an insulative material such as a polyimide resin, a fluororesin, or another resin.

The conductive platen 114 is made of a conductive material so as to have a plate shape having an area corresponding to the electrostatic adsorption means 116 and the entire ejection region of the ejection head 30, and is provided at a position opposing the electrostatic adsorption means 116 and the ejection head 30 so as to contact the back surface of the transport belt 112. Also, the conductive platen 114 is connected to a negative high voltage power supply 115.

The conductive platen 114 generates electric charges on a surface of the recording medium P through the transport belt 112 and the generated electric charges are removed by the grounded electrostatic adsorption means 116, thereby having the recording medium P electrostatically adsorbed on the transport belt 112. In addition, the conductive platen 114 functions as a bias counter electrode at the time of ink ejection from the ejection head 30 by generating an electric field in a space with the ejection head 30.

The surface of the conductive platen 114 may be coated with an insulation layer. In this case, it becomes possible to effectively suppress discharging at the time of image formation by the ejection head 30.

The conductive platen 114 is arranged at a position opposing the ejection head 30 so that the transport belt 112 stretches out to the ejection head 30 side with reference to a position under a state where the transport belt 112 is stretched between the rollers 16*a* and 16*b*. With this construction, fluttering of the transport surface of the transport belt 112 is suppressed and the distance between the ejection head 30 and the recording medium P is maintained constant. As a result, the ink droplets ejected from the ejection head 30 impinge on the recording medium P at precise positions with precise sizes, which makes it possible to draw a high-quality image.

It should be noted here that in order to maintain the distance between the ejection head 30 and the recording medium P transported by the transport belt 112 constant, in place of the above-mentioned method where the. conductive platen 114 is used, a tension member for having the transport belt 112 pass by a home position under a stretched state may be provided for the back surface of the transport belt 112 at a position opposing the ejection head 30. As the tension member, it is possible to use a conductive roller or the like, for instance. These constructions are also applicable to the ink jet printer 10 shown in FIG. 1 and each embodiment of the present invention such as a third embodiment to be described later.

The electrostatic adsorption means 116 is a grounded conductive roller and contacts a surface of the recording medium P fed by the feed roller 12, thereby removing electrical charges generated on the surface of the recording medium P through the transport belt 112 by the conductive platen 114 and having the recording medium P electrostatically adsorbed on the transport belt 112. That is, the recording medium P fed by the feed roller 12 is electrostatically adsorbed on the transport belt 112 while being transported between the electrostatic adsorption means 116 and the conductive platen 114.

The recording medium P is transported by the transport belt 112 to a recording position by the ejection head 30. In an image forming portion by the ejection head 30, the conductive platen 114 biased to a negative high voltage functions as a counter electrode. By applying a recording signal voltage to each ejection electrode of the ejection head 30 under this condition, ink droplets are ejected and an image is formed on the recording medium P.

The recording medium P, on which the image has been formed, is discharged by the roller 16*c* and the discharge means 117, is peeled off the transport belt 112 by a peeling means 24, and is transported to the fixing/transporting means 26. The discharge means 117 of this embodiment is a grounded conductive roller and the roller 16*c* is also a grounded conductive roller, so that by transporting the recording medium P between the roller 16*c* and the discharge means 117, the electric charges, accumulated on the surface of the recording medium P are removed and the recording medium P is discharged.

The recording medium P peeled off the transport belt 112 is preliminarily heated by the preliminary heating means 117 for fixing and drying. The preliminary heating means 117 is connected to the solvent removing means 44. The solvent removing means (solvent removing device 44) removes the solvent from the solvent-containing air collected by the solvent collecting means (hood 40 and duct 42). The preliminary heating means 117 preliminarily heats the recording medium P by blowing high-temperature dry air obtained after the solvent removal on the image recording surface of the recording medium P. The preliminary heating means 117 is not limited to the direct use of the high-temperature dry air for preliminary heating of the recording medium P, and heat energy may be indirectly used, for example, the heat energy of the high-temperature air may be extracted by a heat exchanger and used in heating air for preliminarily heating the recording medium P or a heater.

The preliminarily heated recording medium P is sent to the fixing/transporting means 26 which then fixes the image formed on the recording medium P. In this embodiment, like in the first embodiment described above, a heat roll 26*a* is used as the fixing/transporting means 26 that transports the recording medium P and heat-fixes the image formed on the recording medium P in a contact manner.

In addition to the hood 40 and the duct 42 in the ink jet printer 10, a blowing means 119 is also provided as a means for collecting solvent vapor generated in large quantities at the time of fixing. The hood 40 is provided so as to shield a portion of the recording medium P heated by the fixing/transporting means 26 as much as possible except the blower port of the blowing means 119.

The blowing means 119 is provided on the downstream side of the contact portion between the recording medium P and the heat roll 26*a* to blow the solvent-containing air generated in the fixing/transporting means 26 into the hood 40. In this embodiment, the heat roll 26*a* is used for the fixing means and hence a larger quantity of the solvent vapor is generated from the ink of the recording medium P on the downstream side of the heat roll 26*a*. Therefore, air containing a large quantity of solvent can be selectively collected by providing the blowing means 119 on the downstream side of the heat roll 26*a* as in this embodiment. Further, the blowing means 119 blows the air in proximity to the discharge port for the recording medium P toward the hood 40, in other words, toward the inside of the ink jet printer 100, so that the solvent vapor can be prevented from flowing out of the ink jet printer 100.

A similar apparatus to the solvent removing device 44 in the ink jet printer 10 is used as the means for removing the solvent from the solvent-containing air collected by the solvent collecting means. As described above, the hood 40, the duct 42 and the blowing means 117 are used to selectively collect the air containing a large quantity of solvent among air in the ink jet printer 100, which makes it possible to efficiently remove the solvent in the solvent removing device 44. The solvent-containing air collected in the solvent removing device 44 is high-temperature air collected in proximity to the heat roll 26*a*, and the high-temperature dry air from which the solvent was removed in the solvent removing device 44 is sent to the preliminary heating means 117. Heating energy required for fixing in the heat roll 26*a* can be thus reduced by preliminarily heating the recording medium P making use of heat energy of the collected high-temperature air.

<Third Embodiment>

Next, a third embodiment of the ink jet recording apparatus of the present invention will be described.

Figure 7:
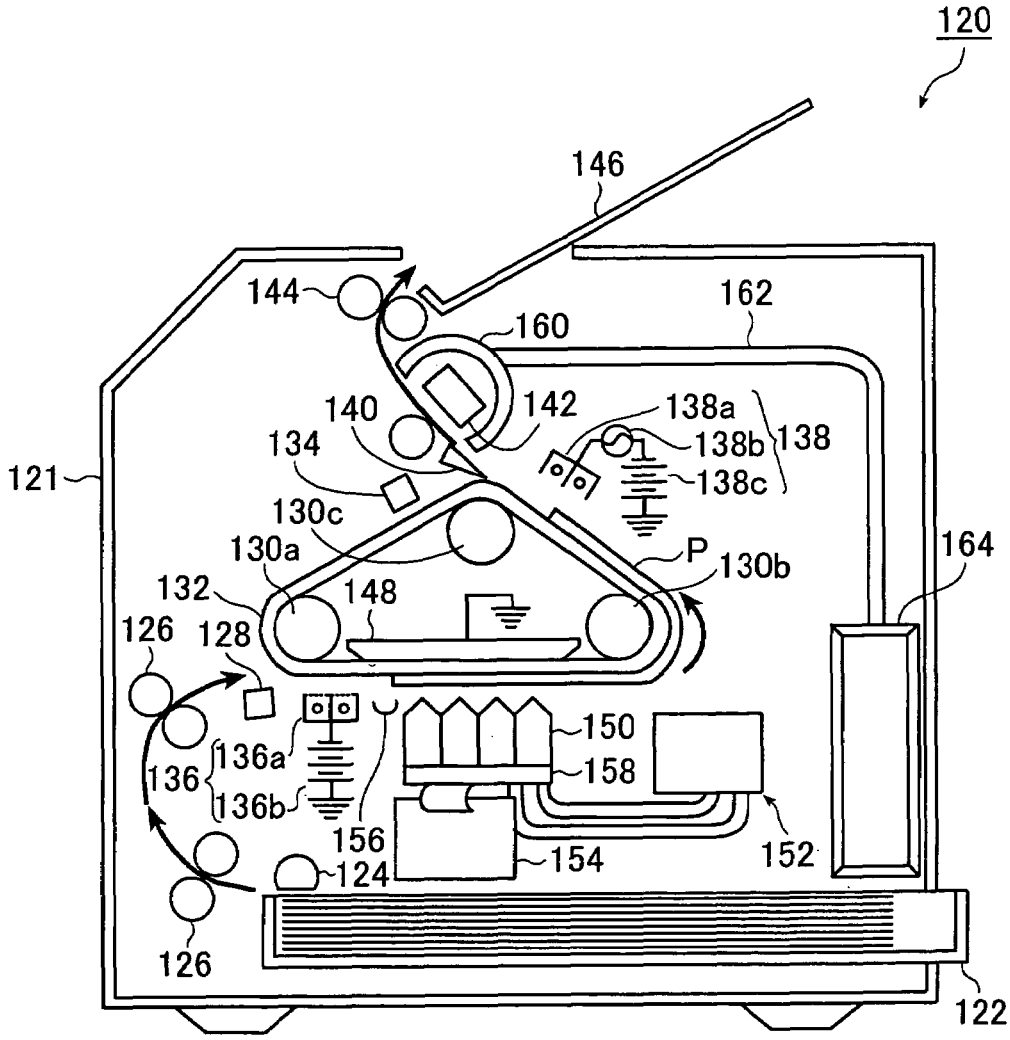
FIG. 7 is a schematic construction diagram showing a third embodiment of the ink jet recording apparatus according to the present invention.

An ink jet printer 120 shown in FIG. 7 includes a recording medium stocker 122 that is insertable into or extractable from an enclosure 121. As a means for transporting a recording medium P, the ink jet printer 120 includes a pickup roller 124, feed roller pairs 126, a dust removing means 128, rollers 130*a*, 130*b*, and 130*c*, a transport belt 132, an electrostatic adsorption means 136, a discharge means 138, a peeling means 140, a fixing means 142, and a discharge roller pair 144. With this construction, a recording medium P stocked in the stocker 122 is transported to each process step and is then discharged onto a discharge tray 146.

Also, as an image forming means, the ink jet printer 120 includes a platen 148, an ejection head 150, an ink circulation system 152, a head driver 154, a recording medium position detection means 156, and a recording position control means 158. Further, the ink jet printer 120 includes a hood 160 and a duct 162 as a means for collecting solvent-containing air and includes a solvent removing device 164 as a means for removing solvent. These construction elements are provided in an enclosure 121.

The ink jet printer 120 shown in FIG. 7 operates in the same manner as the ink jet printer 10 shown in FIG. 1 and the ink jet printer 100 shown in FIG. 6. That is, the ink jet printer 120 forms an image by ejecting ink droplets onto the recording medium P in accordance with image data and fixes the formed image, thereby recording the image. However, the ink jet printer 120 differs from the ink jet printer 10 and the ink jet printer 100 in that the stocker 122 is provided inside the enclosure 121, the grounded conductive platen 148 is provided as an image forming means, the fixing means 142 performs heat-fixing in a non-contact manner, and the hood 160 is a hood designed for the fixing means 142.

First, the means for transporting the recording medium P in the ink jet printer 120 will be described.

The stocker 122 is capable of stocking multiple sheet-shaped recording media P, and is extractably inserted into the enclosure 121.

The pickup roller 124 is a roller for picking up the recording media P stocked in the stocker 122 one by one and sending the picked-up recording medium P to a recording medium transport path.

The feed roller pairs 126 are each a roller pair that feeds the recording medium P sent from the stocker 122 to the transport belt 132 (portion supported by the roller 130*a*). The recording medium transport path for the recording medium P between the stocker 122 and the transport belt 132 is formed by the multiple feed roller pairs 126. Note that aside from this form where the transport path between the stocker 122 and the transport belt 132 is formed by the multiple feed roller pairs 126, the transport path may be formed by at least one feed roller pair 126 and guide plates.

The dust removing means 128 is provided on the transport path immediately before a position at which the recording medium P is supplied to the transport belt 132, and removes foreign matters, such as dust or paper waste adhering to the recording medium P. As the dust removing means 128, an apparatus is used which uses a known non-contact method, such as suction removal, blowing-off removal, or electrostatic removal, or a contact method using a brush, a roller, or the like.

The rollers 130*a*, 130*b*, 130*c* stretch and move the transport belt 132 and at least one of the rollers 130*a*, 130*b*, and 130*c* is connected to a not-shown drive source.

The transport belt 132 transports the recording medium P to a portion in which image formation is performed by the ejection head 150, moves the recording medium P in the main scanning direction during the image formation, and transports the recording medium P to the fixing means 142 after the image formation. In this embodiment, like in the embodiments described above, an endless belt made of a material that has superior dimensional stability and high endurance is used as the transport belt 132. Also, the recording medium P is held on the transport belt 132 through electrostatic adsorption. Further, the grounded conductive platen 148 is provided so as to contact the back surface of the transport belt 132 between the roller 130*a* and the roller 130*b*, so that a belt that is the same as the transport belt 18 shown in FIG. 1 is used as the transport belt 132.

Within a region of the traveling path of the transport belt 132, in which the recording medium P is not transported (region between the roller 130*a* and the roller 130*c* in FIG. 7), a cleaner 134 is provided for the transport belt 132 and removes dust, scattered color particles, scattered dispersion resin particles, and the like adhering to the transport belt 132 due to an electrostatic force or the like.

The electrostatic adsorption means 136 has the recording medium P adsorbed and held on the transport belt 132 by means of an electrostatic force and charges the recording medium P to a predetermined potential in order to apply a predetermined bias with respect to the ejection head 150 for image formation.

For this purpose, the electrostatic adsorption means 136 includes a scorotron charger 136*a* that charges the recording medium P and a negative high voltage power supply 136*b* connected to the scorotron charger 136*a*. The recording medium P is charged to a negative high voltage by the scorotron charger 136*a* connected to the negative high voltage power supply 136*b* and is electrostatically adsorbed on the insulative transport belt 132.

Then, after the recording medium P is electrostatically adsorbed on the transport belt 132 by means of an electrostatic force so that no floating of the recording medium P occurs, the electrostatic adsorption means 136 uniformly charges a surface of the recording medium P transported by the transport belt 132.

The construction and operation of the electrostatic adsorption means 136 are basically the same as those of the electrostatic adsorption means 20 of the ink jet printer 10 shown in FIG. 1.

The recording medium P charged by the electrostatic adsorption means 136 is transported by the transport belt 132 to the position of the ejection head 150 to be described later. In the image forming portion by the ejection head 150, ink is ejected by regarding the charge potential of the recording medium P as a bias, thereby forming an image on the recording medium P.

The recording medium P, on which the image has been formed, is discharged by the discharge means 138, is peeled off the transport belt 132 by the peeling means 140, and is sent to the fixing means 142 by a transport means such as a transport roller.

The discharge means 138 includes a corotron discharger 138*a*, an AC power supply 138*b*, and a negative high voltage power supply 138*c*. The constructions and operations of the discharge means 138 and the peeling means 140 of this embodiment are the same as those of the discharge means 22 and the peeling means 24 of the ink jet printer 10 shown in FIG. 1, so that the description thereof is omitted in this embodiment.

The fixing means 142 is a heater that is provided at a position opposing the transport surface of the recording medium P with a predetermined distance in-between and heats the recording medium P in a non-contact manner. The fixing means 142 uniformly heats the recording medium P transported at a constant speed, thereby fixing the image formed on the recording medium P.

The recording medium P, on which the image has been fixed by the fixing means 142, is transported to the discharge roller pair 144 by a not-shown transport means such as a transport roller pair, and is discharged onto the discharge tray 146 by the discharge roller pair 144.

The construction and operation of the image forming means of the ink jet printer 120 are the same as those of the image forming means of the ink jet printer 10 shown in FIG. 1 and the ink jet printer 100 shown in FIG. 6, so that the description thereof is omitted in this embodiment.

Next, a means for collecting solvent-containing air and a means for removing the solvent in this embodiment will be described.

As described above, the ink jet printer 120 includes the hood 160 and the duct 162 as a collecting means and includes the solvent removing device 164 as a removing means.

In the ink jet printer 120, a heater is used as the fixing means 142 and performs heat-fixing in a non-contact manner. When the recording medium P is heated by the fixing means 142, a solvent in ink forming an image on the recording medium P is vaporized, so that the atmosphere in proximity to the fixing means 142 is filled with high-temperature air containing a large quantity of solvent.

The hood 160 of the collecting means is provided so as to cover the fixing means 142 and a transport region in which the recording medium P is heated by the fixing means 142, and to shield this region as much as possible. With this construction, almost all of the solvent-containing air is collected. By shielding the region in proximity to the fixing means 142 with the hood 160, it becomes possible to selectively collect air containing a large quantity of solvent.

The solvent removing device 164 collects the solvent-containing air using the hood 160 and the duct 162 connecting the hood 160 to the solvent removing device 164, and removes the solvent from the collected solvent-containing air. The construction and operation of the solvent removing device 164 are the same as those of the solvent removing device 44 of the ink jet printer 10 described above. The air containing a large quantity of solvent is collected using the hood 160, so that it becomes possible for the solvent removing device 44 to efficiently remove the solvent of the solvent-containing air.

<Fourth Embodiment>

Figure 8:
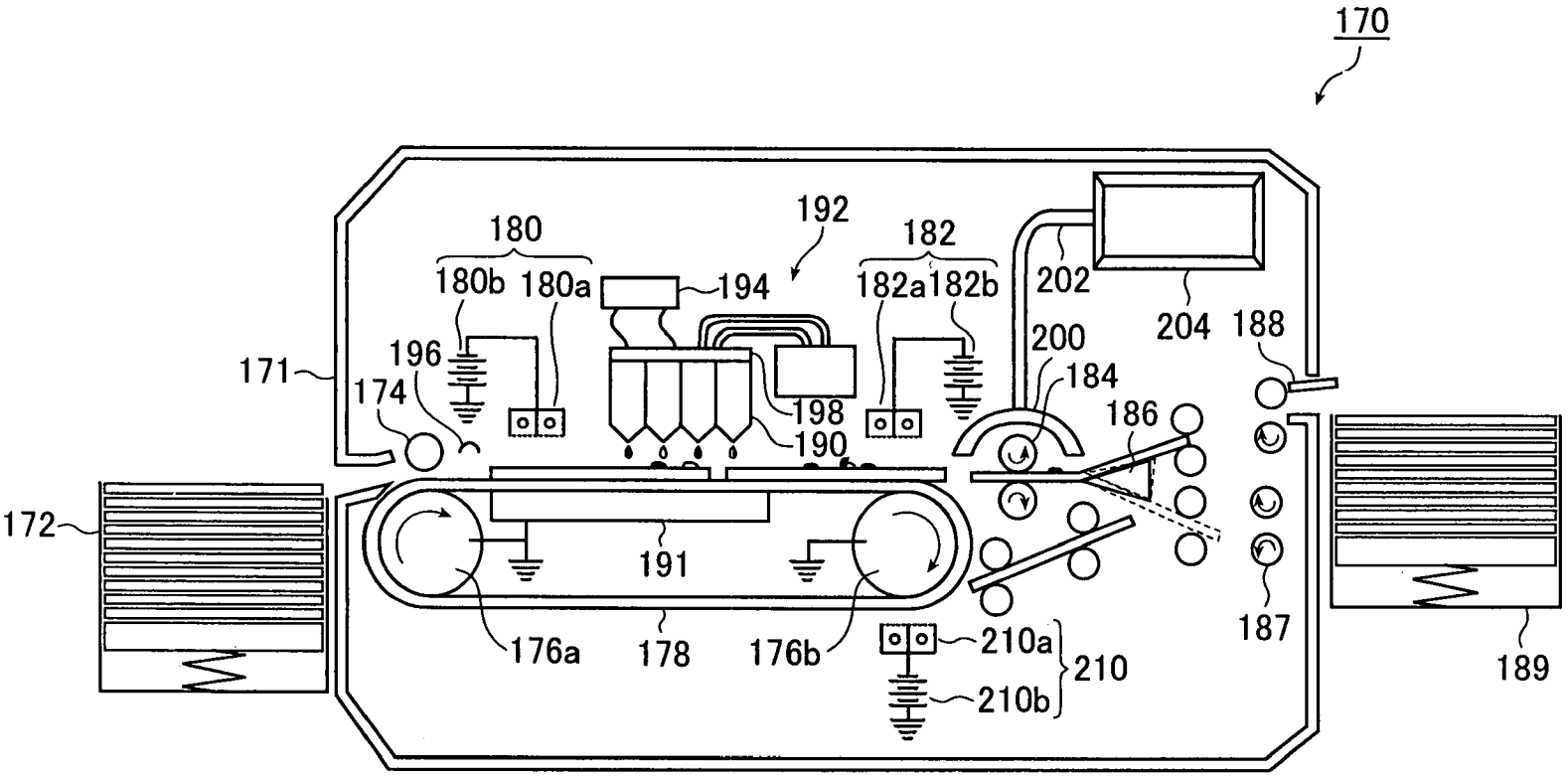
FIG. 8 is a schematic construction diagram showing a fourth embodiment of the ink jet recording apparatus according to the present invention.

FIG. 8 is a schematic construction diagram of an ink jet printer that is a fourth embodiment of the ink jet recording apparatus according to the present invention.

An ink jet printer 170 shown in FIG. 8 includes, as a means for transporting a recording medium P, a feed roller 174, rollers 176*a* and 176*b*, a transport belt 178, electrostatic adsorption means 180 and 210, a discharge means 182, a fixing/transporting means 184, a sheet direction switching means 186, a reverse roller 187, and a discharge guide 188. With this construction, recording media P stocked in a stocker 172 are transported to each process step and are discharged onto a discharged sheet stocker 189 one by one.

Also, as an image forming means, the ink jet printer 170 includes a grounded conductive platen 191, an ejection head 190, an ink circulation system 192, a head driver 194, a recording medium position detection means 196, and a recording position control means 198. Further, the ink jet printer 170 includes a hood 200 and a duct 202 as a means for collecting solvent-containing air and includes a solvent removing device 204 as a solvent removing means. These construction elements are provided in an enclosure 171.

After an image is recorded on one surface of a recording medium P, the ink jet printer 170 automatically reverses the recording medium P, transports the reversed recording medium P through the same transport path again, and records an image on the other surface of the recording medium P. That is, the ink jet printer 170 is a printer that is capable of performing double-sided printing.

A recording medium P picked up from the stocker 172 is supplied onto the transport belt 178 by the feed roller 174. Then, the electrostatic adsorption means 180, which includes a scorotron charger 180*a* and a negative high voltage power supply 180*b* like in the case of the electrostatic adsorption means 20 shown in FIG. 1, has the recording medium P electrostatically adsorbed on the transport belt 178 and uniformly charges a surface of the recording medium P. Following this, the recording medium P is transported to the position of the ejection head 190.

The rollers 176*a* and 176*b* are conductive rollers that stretch and move the transport belt 178. At least one of the rollers 176*a* and 176*b* is connected to a drive source and each thereof is grounded.

The transport belt 178 is an endless belt that sequentially holds and transports multiple recording media P at a constant speed. As the transport belt 178, it is possible to use the same belt as the transport belt 18 shown in FIG. 1.

Like the ink jet printer 10 shown in FIG. 1, during image formation by the ejection head 190 on the recording medium P, the ejection head 190 receives application of recording signal voltages and ejects ink using the charge potential of the recording medium P as a bias. In this manner, an image is formed on the recording medium P.

The recording medium P, on which the image has been formed, is discharged by the discharge means 182 composed of a DC scorotron discharger 182*a* and a negative high voltage power supply 182*b*, is peeled off the transport belt 178, and is sent to the fixing/transporting means 184.

The fixing/transporting means 184 is a heat roll that fixes the image formed on the recording medium P by heating the recording medium P in a contact manner.

In proximity to the fixing/transporting means 184, the hood 200 is provided so as to shield a portion of the recording medium P heated by the fixing/transporting means 184 as much as possible, and selectively collects air containing a large quantity of solvent. With this construction, it becomes possible to efficiently remove the solvent using the solvent removing device 204.

In the case of one-sided printing, the recording medium P, on which the image has been fixed by the fixing/transporting means 184, is sent to the discharge guide 188 by the sheet direction switching means 186 and is discharged onto the discharged sheet stoker 189.

On the other hand, in the case of two-sided printing, the recording medium P having undergone the image fixation is sent to the reverse roller 187 by the sheet direction switching means 186. When the recording medium P is sent to the reverse roller 187 by a predetermined length, this roller starts rotation in a direction (counterclockwise direction in the drawing) in which the recording medium P is sent back, thereby sending the recording medium P to a path on a returning side of the transport belt 178. It should be noted here that an idling roller or the like may be provided as appropriate between the sheet direction switching means 186 and the reverse roller 187. Also, a transport roller pair may be provided as appropriate between the reverse roller 187 and the transport belt 178.

Next, after being reversed by the reverse roller 187 and returned to the transport belt 178, the recording medium P is electrostatically adsorbed on the transport belt 178 by the electrostatic adsorption means 210 composed of a scorotron charger 210*a* and a negative high voltage power supply 210*b* at the position of the grounded roller 176*b*, and is transported by the transport belt 178. When doing so, the surface of the recording medium P, on which the image has been recorded, contacts the transport belt 178 and the other surface thereof, on which an image is to be recorded next, is directed outward.

After being transported to the position of the electrostatic adsorption means 180 again, the surface of the recording medium P is uniformly charged by the electrostatic adsorption means 180. Following this, image recording and discharging onto the discharged sheet stocker 189 are performed in the same manner as above.

In each embodiment described above, an ink jet recording apparatus that records a color image using ink in four colors of C, M, Y, and K has been described, although the present invention is not limited to this. For instance, the present invention may be applied to a monochrome recording apparatus or a recording apparatus that also uses ink in other colors such as light colors or special colors.

Also, in each embodiment described above, an ink jet recording apparatus has been described which performs image recording using ink ejected by positively charged color particles in ink and setting a recording medium or a counter electrode on the back surface of the recording medium at a negative high voltage. However, the present invention is not limited to this and may be applied to an apparatus that performs image recording using ink ejected by negatively charged color particles in ink and setting a recording medium or a counter electrode at a positive high voltage. When the polarity of the charged color particles are set opposite to that in the embodiments described above in this manner, the polarities of voltages applied to the electrostatic adsorption means, the counter electrode, and the drive electrodes of the electrostatic ink jet head and the like are set opposite to those in the embodiments described above.

Further, the present invention is not limited to a ink jet recording apparatus that uses ink containing charged color particles and may be modified, for instance, to an application apparatus that applies a liquid by ejecting droplets using charged particles.

The ink jet recording apparatus according to the present invention has been described in detail above, although the present invention is not limited to the embodiments described above. That is, it is of course possible to make various modifications and changes without departing from the gist of the present invention.

As described in detail above, with the ink jet recording apparatus according to the present invention, it becomes possible to selectively collect air in proximity to a fixing means that generates the largest quantity of solvent vapor and to efficiently remove the solvent vapor. As a result, miniaturization of the solvent collecting device can be achieved, which makes it possible to miniaturize the ink jet recording apparatus and to achieve a reduction in power consumption. Also, according to the present invention, it becomes possible to suppress the amount of water vapor absorbed by a solvent absorption material. As a result, unnecessary degradation of the solvent absorption material can be prevented, which makes it possible to improve maintainability, that is, to achieve a stabilized operation. In addition, it becomes easy to extract the solvent absorbed by the solvent absorption material and to reuse the extracted solvent.

Also, with the ink jet recording apparatus according to the present invention, in addition to removal of solvent vapor from collected air and reuse of the removed solvent, it becomes possible to recover heat energy generated by a fixing means or the like and to reuse the recovered heat energy as drying energy, resulting in the reduction of the amount of energy used for drying and power saving.

Further, according to the present invention, it becomes possible to prevent leakage of heat generated by a fixing means or the like, which makes it possible to prevent drying of ink at an image forming means (in particular, ejection nozzles of an ejection head) and to suppress lowering of stability of ink ejection due to changes in physical properties, such as viscosity, of the ink. As a result, high-quality image recording can be achieved.

What is claimed is:

1. An ink jet recording apparatus comprising:

image forming means for forming an image on a recording medium by ejecting ink containing a solvent and color particles dispersed in said solvent;

fixing means for fixing said image formed on said recording medium by said image forming means;

collecting means for selectively collecting air containing said solvent from an atmosphere in proximity to said fixing means; and removing means for removing said solvent from said solvent-containing air collected by said collecting means, wherein at least a portion of said fixing means is positioned inside of said collecting means.

2. The ink jet recording apparatus according to claim 1, wherein said collecting means includes shield means for shielding at least a region in proximity to said fixing means.

3. The ink jet recording apparatus according to claim 2, wherein said collecting means includes suction means for sucking and collecting said solvent-containing air from the region shielded by said shield means.

4. The ink jet recording apparatus according to claim 2, wherein said collecting means includes blowing means for blowing said solvent-containing air in the region shielded by said shield means to an opening of said collecting means.

5. The ink jet recording apparatus according to claim 2, wherein said fixing means includes a heating section that heats and fixes said image formed on said recording medium by said image forming means, and wherein said shield means shields at least a region in proximity to said heating section.

6. The ink jet recording apparatus according to claim 5, further comprising:

preliminary heating means for preliminary heating said recording medium on which said image has been formed by said image forming means using air which has been collected by said collecting means and from which said solvent has been removed by said removing means, or heat of said air, prior to heating and fixing by said fixing means, said preliminary heating means being provided between said image forming means and said fixing means.

7. The ink jet recording apparatus according to claim 5, wherein said recording medium on which said image has been formed by said image forming means is preliminary heated using air which has been collected by said collecting means and from which said solvent has been removed by said removing means, or heat of said air, to assist fixing of said image by said fixing means.

8. The ink jet recording apparatus according to claim 1, further comprising:

drying means for drying said recording medium on which said image has been formed by said image forming means using air which has been collected by said collecting means and from which said solvent has been removed by said removing means, or heat of said air.

9. The ink jet recording apparatus according to claim 1, wherein said collecting means includes a curved hood.

10. The ink jet recording apparatus according to claim 1, wherein at least a portion of the fixing means is positioned between said recording medium and said collecting means when said image is fixed by said fixing means.

11. The ink jet recording apparatus according to claim 1, wherein said collecting means includes a hood, and said at least a portion of said fixing means is disposed inside of an area defined by the hood.

12. An ink jet recording apparatus comprising:

an ejection head which forms an image on a recording medium by ejecting ink containing a solvent and color particles dispersed in said solvent;

a heating device which fixes said image formed on said recording medium by said ejection head;

a hood which selectively collects air containing said solvent from an atmosphere in proximity to said heating device; and a solvent removing device which removes said solvent from said solvent-containing air collected by said hood, wherein at least a portion of said heating device is positioned inside of said hood.

13. The ink jet recording apparatus according to claim 12, wherein said hood comprises a shield which shields at least a region in proximity to said heating device.

14. The ink jet recording apparatus according to claim 13, further comprising a blower which blows said solvent-containing air to an opening of said hood.

15. The ink jet recording apparatus according to claim 13, wherein said heating device heats and fixes said image formed on said recording medium by said ejection head, and wherein said shield shields at least a region in proximity to said heating device.

16. The ink jet recording apparatus according to claim 15, further comprising:

a preliminary heater which preliminarily heats said recording medium on which said image has been formed by said ejection head using air which has been collected by said hood and from which said solvent has been removed by said solvent removing device, prior to heating and fixing by said heating device, said preliminary heater being provided between said ejection head and said heating device.

17. The ink jet recording apparatus according to claim 15, wherein said recording medium on which said image has been formed by said ejection head is preliminarily heated using air which has been collected by said hood and from which said solvent has been removed by said solvent removing device, to assist fixing of said image by said heating device.

18. The ink jet recording apparatus according to claim 13, wherein said hood is in communication with a suction device which sucks and collects said solvent-containing air from the region shielded by said shield.

19. The ink jet recording apparatus according to claim 12, further comprising:

a dryer which dries said recording medium on which said image has been formed by said ejection head using air which has been collected by said hood and from which said solvent has been removed by said solvent removing device.

20. The ink jet recording apparatus according to claim 12, wherein said hood is curved.

21. The ink jet recording apparatus according to claim 12, wherein at least a portion of said heating device is positioned between said recording medium and said hood when said image is fixed by said heating device.

22. The ink jet recording apparatus according to claim 12, wherein said hood has a curved shape, and said at least a portion of said heating device is disposed inside of an area defined by the curved shape of the hood.

* * * * *